US009251757B2

(12) United States Patent
Suzuki et al.

(10) Patent No.: US 9,251,757 B2
(45) Date of Patent: Feb. 2, 2016

(54) DRIVING CIRCUIT FOR DRIVING A DISPLAY APPARATUS BASED ON DISPLAY DATA AND A CONTROL SIGNAL, AND A LIQUID CRYSTAL DISPLAY APPARATUS WHICH USES THE DRIVING CIRCUIT

(75) Inventors: Takamitsu Suzuki, Osaka (JP); Katsutoshi Kobayashi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 396 days.

(21) Appl. No.: 13/166,545

(22) Filed: Jun. 22, 2011

(65) Prior Publication Data

US 2011/0316821 A1 Dec. 29, 2011

(30) Foreign Application Priority Data

Jun. 23, 2010 (JP) ..... 2010-143187

(51) Int. Cl.
*G09G 3/36* (2006.01)

(52) U.S. Cl.
CPC ..... *G09G 3/3688* (2013.01); *G09G 2310/027* (2013.01); *G09G 2310/08* (2013.01); *G09G 2330/025* (2013.01); *G09G 2330/06* (2013.01)

(58) Field of Classification Search
USPC ..... 345/87–104
See application file for complete search history.

(56) References Cited

U.S. PATENT DOCUMENTS 5,179,438 A * 1/1993 Morimoto ..... H03K 5/131 327/263
5,982,408 A * 11/1999 Overall ..... G06K 15/1219 327/150
6,188,443 B1 * 2/2001 Mori ..... G09G 5/008 348/537
6,345,099 B1 * 2/2002 Alvarez ..... H04N 5/913 380/201
6,407,729 B1 * 6/2002 Moon ..... 345/99
6,433,766 B1 8/2002 Chen
2003/0222606 A1 * 12/2003 Kim ..... G09G 1/04 315/370
2004/0150659 A1 * 8/2004 Nakano ..... G06F 3/14 345/629
2004/0164886 A1 8/2004 Hsueh
2004/0189579 A1 * 9/2004 Shimizu ..... 345/98
2004/0227717 A1 11/2004 Yeh
2005/0225517 A1 10/2005 Sun
2005/0285653 A1 * 12/2005 Chung ..... H03L 7/0814 327/276

(Continued)

FOREIGN PATENT DOCUMENTS

JP 7-239675 A 9/1995
JP 8-22267 A 1/1996

(Continued)

OTHER PUBLICATIONS

Japanese Office Action for counterpart JP application mailed Mar. 21, 2013.

(Continued)

*Primary Examiner* — Sanghyuk Park
(74) *Attorney, Agent, or Firm* — Birch, Stewart, Kolasch & Birch, LLP

(57) ABSTRACT

A driving circuit according to the present invention for driving a display apparatus based on display data and a control signal includes: a delay circuit for delaying the input control signal; and a data load section for loading the input display data to the display apparatus at a timing generated by the delayed control signal, where the delay circuit delays the control signal in such a manner that load timing at which the display data is loaded to the display apparatus varies according to fixed timing determined by a constant cycle.

19 Claims, 15 Drawing Sheets

(56) References Cited

U.S. PATENT DOCUMENTS

| | | | | |
|---|---|---|---|---|
| 2007/0024569 | A1* | 2/2007 | Koyama et al. | 345/100 |
| 2007/0132696 | A1* | 6/2007 | Yamashita | 345/98 |
| 2009/0303226 | A1 | 12/2009 | Kim | |

FOREIGN PATENT DOCUMENTS

| | | | |
|---|---|---|---|
| JP | 11-288339 | A | 10/1999 |
| JP | 2003-66888 | A | 3/2003 |
| JP | 2008-262132 | A | 10/2008 |
| JP | 2010-39061 | A | 2/2010 |
| KR | 10-2004-0084854 | A | 10/2004 |
| TW | 591593 | | 6/2004 |
| TW | 594634 | | 6/2004 |
| TW | I239496 | | 9/2005 |
| TW | 20087356 | A | 2/2008 |

OTHER PUBLICATIONS

Korean Office Action dated Nov. 1, 2012.
Taiwanese Office Action for corresponding application dated Mar. 17, 2014.

* cited by examiner

DRIVING CIRCUIT FOR DRIVING A DISPLAY APPARATUS BASED ON DISPLAY DATA AND A CONTROL SIGNAL, AND A LIQUID CRYSTAL DISPLAY APPARATUS WHICH USES THE DRIVING CIRCUIT

This nonprovisional application claims priority under 35 U.S.C. §119(a) to Patent Application No. 2010-143187 filed in Japan on Jun. 23, 2010, the entire contents of which are hereby incorporated by reference.

BACKGROUND OF THE INVENTION

1. Field of the Invention

The present invention relates to a driving circuit, a liquid crystal display apparatus and an electronic information device, and more particularly, the present invention relates to a driving circuit for driving a display panel, such as a liquid crystal display panel, which is configured to disperse peak current; a liquid crystal display apparatus equipped with such a driving circuit; and an electronic information device including such a liquid crystal display apparatus.

2. Description of the Related Art

Flat display apparatuses, such as a liquid crystal display apparatus, have conventionally included a display panel such as a liquid crystal display, a driver for driving the display panel, and a control circuit for controlling the driver.

In recent years, as these display apparatuses become larger, have higher definition and are driven faster, the output frequency of display signals (gradation voltage) to be output as display data to a display panel becomes higher and the number of display signals to be output increases. As a result, in a data driver for driving such a display panel, unnecessary radiation caused during data outputting has become problematic.

Hereinafter, a detailed description will be provided with an example of a conventional data driver for driving a display panel.

FIG. 14 is a block diagram describing a configuration of a conventional data driver.

A data driver 901 shown in FIG. 14 has n-numbered signal output terminals 911-1 to **911-*n*, and the data driver 901** is capable of outputting display signals for indicating display data (gradation data) of a p gradation from each of the output terminals to a data line of a display panel.

In summary, the data driver 901 includes, as signal input terminals to which signals are input from the outside, a clock input terminal 902, a plurality of gradation data input terminals 903, a control signal input terminal 904, and reference voltage terminals 905 to 909. The data driver 901 also includes n-numbered signal output terminals 911-1 to **911-*n***, from which signals are output to a liquid crystal display panel.

The data driver 901 includes, as internally provided circuits, a reference voltage correcting circuit 921, a pointer shift register section 923 for operating based on a clock signal CLK, a latch circuit section 924 for latching and sampling display data, a hold circuit section 925 for latching and holding latched-and-sampled display data, a D/A converter (Digital Analog Converter) section 926 for performing a D/A conversion on latched-and-held display data, and an output buffer section 927 for outputting display data subject to D/A conversion.

Herein, the pointer shift register section 923 includes n stages of shift registers 923-1 to **923-*n*. The latch circuit section 924 includes n latch circuits 924-1 to 924-*n*. The hold circuit section 925 includes n hold circuits 925-1 to 925-*n*. The D/A converter section 926 includes n D/A converter circuits 926-1 to 926-*n*. The output buffer section 927 includes n output buffers 927-1 to 927-*n***, each constituted of an operational amplifier.

Next, the operation of the apparatus described above will be described.

In the data driver 901 with such a configuration, an input of display data DATA, a data control signal LOAD, and a clock signal CLK from a control circuit (now shown) for controlling the driver 901 allows the pointer shift register section 923 to select one of latch circuits 924-1 to **924-*n* in accordance with the clock signal CLK input to the clock input terminal 902. In such a condition, an input of the gradation data DATA from the gradation data input terminal 903 causes a sampling value of the gradation data to be stored in the selected latch circuit in the latch circuit section 924**.

In addition, latch circuit selection signals output from the pointer shift register section 923 cause a first stage latch circuit 924-1 to an nth stage latch circuit **924-*n* to be selected consecutively by the clock signal input from the clock input terminal 902. Therefore, an input of n clocks enables storage of the gradation data in all of the latch circuits 924-1 to 924-*n*. In addition, the gradation data stored in the latch circuits 924-1 to 924-*n* is transferred to corresponding n hold circuits 925-1 to 925-*n* by the control signal LOAD, to be digital input data of D/A converters 926-1 to 926-*n***.

The D/A converters 926-1 to **926-*n* select and output one of p types of gradation voltages to be input, according to the digital input data above. P types of gradation voltages are generated by the reference voltage correcting circuit 921 based on reference voltages V0 to V4 input from respective reference voltage terminals 905 to 909**.

Further, the output buffer section 927 performs an impedance conversion on the gradation voltages output from the D/A converters 926-1 to **926-*n*, and the gradation voltages are output to data lines of a liquid crystal display panel (not shown) as driving signals from each of the signal output terminals 911-1 to 911-*n*** to the liquid crystal display panel.

In the conventional data driver 901 with such a configuration, since data transferring is performed from the hold circuits 925-1 to **925-*n* to the D/A converter circuits 926-1 to 926-*n* all together by the control signal LOAD as described above, the gradation voltages output from the D/A converter circuits 926-1 to 926-*n* are simultaneously changed. Thus, a large amount of current is generated instantaneously in the data driver 901. This current has an extremely large value due to the increase in the number of the signal output terminals 911-1 to 911-*n* and the increase in the driving performance by the output buffer section 927. Owing to this fact, not only is more current consumed by the data driver 901**, but also unnecessary radiation caused by the current becomes problematic.

Accordingly, a method disclosed in Reference 1 has been proposed as a method for preventing peak current from increasing due to concentrated current.

FIG. 15 is a diagram describing a configuration of a data driver disclosed in Reference 1.

In a data driver 300 in FIG. 15, circuit blocks CB1 to CB4 correspond to the hold circuits, D/A converter circuits and output buffers in the data driver 901 shown in FIG. 14, and respective sets of the circuit blocks CB1 to CB4 are grouped by a plurality of groups CG1 to CGm. In summary, the circuit blocks CB1 to CB4 in each group correspond to respective data lines of a liquid crystal display panel, and they output display data to corresponding data lines.

Further, in the data driver 300, the control signal LOAD input via an input protection circuit E (30) is directly input into a first circuit group CG1. The control signal LOAD from the input protection circuit E (30) is input into a second circuit group CG2 via a first delay circuit 31*a*1. The control signal LOAD is input into a third circuit group CG3 via the first delay circuit 31*a*1 and a second delay circuit 31*a*2. In summary, the control signal LOAD is input into an m circuit group CGm via a first to m−1 delay circuits 31*a*1 to 31*am*-1.

Thus, in a liquid crystal display apparatus equipped with such a data driver, since there is a delay circuit D provided in between circuit groups CG, display output signals (gradation voltages) are output from respective circuit groups CG with each display output signal shifted by a delay period of time of each delay circuit D.

Owing to this configuration, display output signals are dispersed for respective circuit groups CG to be output. Therefore, peak current flowing through a power source line is dispersed even in a case where the number of signals is increased due to higher definition and a wider screen, and unnecessary radiation can also be reduced.

Reference 2 discloses subject matter which causes timing for taking gradation data into a hold circuit to be different between data drivers.

Reference 1: Japanese Laid-Open Publication No. 8-22267

Reference 2: Japanese Laid-Open Publication No. 2008-262132

SUMMARY OF THE INVENTION

As described above, in the data driver described in Reference 1, display output signals (gradation voltages) are output from respective circuit groups CG with each display output signal shifted by a delay period of each delay circuit D, while the intervals at which display signals are output from respective circuit groups is constant. Thus, problems arise where the dispersion of frequency components of driving signals is not sufficient, and unnecessary radiation increases when the display apparatus has a larger screen, has higher definition, and is driven faster.

In a liquid crystal display apparatus disclosed in Reference 2, there also exist problems similar to those in the data driver described in Reference 1.

The present invention is intended to solve the conventional problems described above. The objective of the present invention is to provide for a driving circuit capable of dispersing frequency components of driving signals for driving a display apparatus, such as a liquid crystal display apparatus, to reduce unnecessary radiation; a liquid crystal display apparatus equipped with such a driving circuit; and an electronic information device including such a liquid crystal display apparatus.

A driving circuit according to the present invention for driving a display apparatus based on display data and a control signal, includes: a delay circuit for delaying the input control signal; and a data load section for loading the input display data to the display apparatus at a timing generated by the delayed control signal, where the delay circuit delays the control signal in such a manner that load timing at which the display data is loaded to the display apparatus varies according to fixed timing determined by a constant cycle, thereby achieving the objective described above.

Preferably, in a driving circuit according to the present invention, the input control signal is a signal for generating the fixed timing at the constant cycle, and the delay circuit repeats delay processing for the control signal, in which the load timing is delayed from the fixed timing by a given delay period every time an integral multiple of the constant cycle elapses, within the limits of a delay period of the load timing.

Still preferably, in a driving circuit according to the present invention, the display data and the control signal are included in a video signal supplied to the display apparatus, and the constant cycle is based on a horizontal synchronization period of the video signal.

Still preferably, in a driving circuit according to the present invention, the delay circuit includes: a count circuit for counting the fixed timing generated by the input control signal; and a decoder for decoding a count output of the count circuit, where a delay amount of the control signal is determined based on an output of the decoder.

Still preferably, in a driving circuit according to the present invention, the delay circuit includes: a plurality of delay elements connected in series; and a plurality of switches for switching signal paths of the control signal so that the control signal is delayed by a given number of the delay elements connected in series among the plurality of delay elements, based on an output of the decoder.

Still preferably, in a driving circuit according to the present invention, the delay circuit includes: a shift register for performing a shift operation based on the fixed timing generated by the input control signal; a plurality of delay elements connected in series; and a plurality of switches for switching signal paths of the control signal so that the control signal is delayed by a given number of the delay elements connected in series among the plurality of delay elements, based on an output of the shift register.

Still preferably, a driving circuit according to the present invention includes: a data driver for driving a plurality of data lines of a liquid crystal display panel as the display apparatus; a scanning driver for driving a plurality of scanning lines of the liquid crystal display panel; and a timing controller for generating, based on an input video signal, the display data supplied to the data driver as well as generating, as the control signal, a data control signal supplied to the data driver and a scan control signal supplied to the scanning driver, where: the delay circuit constitutes the data driver; and the delay circuit delays the control signal input to the data driver in such a manner that timing, at which the display data is output from the data driver to a data line of the liquid crystal display panel, varies for each horizontal scanning line according to fixed timing determined based on a horizontal synchronization signal.

Still preferably, a driving circuit according to the present invention includes: a data driver for driving a plurality of data lines of a liquid crystal display panel as the display apparatus; a scanning driver for driving a plurality of scanning lines of the liquid crystal display panel; and a timing controller for generating, based on an input video signal, the display data supplied to the data driver as well as generating, as the control signal, a data control signal supplied to the data driver and a scan control signal supplied to the scanning driver, where: the delay circuit constitutes the timing controller; and the delay circuit delays the control signal generated by the timing controller based on the video signal in such a manner that timing, at which the display data is output from the data driver to a data line of the liquid crystal display panel, varies for each horizontal scanning line according to fixed timing determined based on a horizontal synchronization signal.

Still preferably, a driving circuit according to the present invention includes a data driver for driving a plurality of data lines of a liquid crystal display panel as the display apparatus, where: the delay circuit constitutes the data driver, for delaying the control signal input in the data driver; and the data driver includes: a plurality of driver circuits in a plurality of groups, provided for each data line of the liquid crystal display panel, for driving the corresponding data line, the plurality of driver circuits being grouped into a plurality of groups; and a signal delay section for delaying the control signal supplied to the driver circuits in each group in such a manner that the driver circuits in the same group supply the display data to the data line at the same timing, and the driver circuits in a different group supply the display data to the data line at a different timing.

Still preferably, in a driving circuit according to the present invention, the signal delay section includes a plurality of delay sections connected in series over a plurality of stages; the delay section in a first stage delays the control signal output from the delay circuit; and the delay sections in a second stage and later stages delay the control signal output from the delay section in the previous stage.

Still preferably, in a driving circuit according to the present invention, the delay sections constituting the signal delay section respectively delay the input control signal by a predetermined amount.

Still preferably, in a driving circuit according to the present invention, the plurality of delay sections include: a count circuit for counting timing of a fixed cycle generated by the input control signal; and a decoder for decoding a count output of the count circuit, and a delay amount of the control signal is determined based on an output of the decoder.

Still preferably, in a driving circuit according to the present invention, the plurality of delay sections include: a plurality of delay elements connected in series; and a plurality of switches for switching signal paths of the control signal so that the control signal is delayed by a given number of the delay elements connected in series among the plurality of delay elements, based on an output of the decoder.

Still preferably, in a driving circuit according to the present invention, the plurality of delay sections include: a shift register for performing a shift operation based on fixed cycle timing generated by the input control signal; a plurality of delay elements connected in series; and a plurality of switches for switching signal paths of the control signal so that the control signal is delayed by a given number of the delay elements connected in series among the plurality of delay elements, based on an output of the shift register.

A liquid crystal display apparatus according to the present invention includes a liquid crystal display panel, for displaying an image on the liquid crystal display panel based on a video signal, the liquid crystal display apparatus further including: a driving apparatus for driving the liquid crystal display panel based on the video signal, wherein the driving apparatus includes the driving circuit according to the present invention, thereby achieving the objective described above.

An electronic information device according to the present invention includes a liquid crystal display apparatus, where the liquid crystal display apparatus is the liquid crystal display apparatus according to the present invention, thereby achieving the objective described above.

The functions of the present invention will be described hereinafter.

In the present invention, a delay circuit for delaying input control signals and a data load section for loading input display data to a display apparatus at the timing of the generation of a delayed control signal are included. The control signal is delayed in such a manner that load timing for loading the display data to the display apparatus varies according to fixed timing determined by a constant cycle. As a result, it becomes possible to obtain the effect of reducing unnecessary radiation, which was not sufficiently obtained in the conventional art.

In the present invention, since load timing for a control signal, with reference to fixed timing, is generated a plurality of times in a time series by the delay of a control signal, the size of the circuit for generating the load timing of the control signal a plurality of times can be prevented from being large, which leads to cost reduction.

In the present invention, the driving circuit includes a counter circuit for counting the rise of a pulse of a control signal, so that a delay circuit capable of varying load timing for each horizontal period can be configured without increasing the circuit size, which leads to cost reduction.

In the present invention, a plurality of corresponding circuit blocks for each data signal line form a group with a predetermined number of data signal lines as units, where each of the circuit blocks constitutes a driving circuit. Thus, the load timing of the control signal is generated a plurality of times in a time series with reference to the fixed timing. As a result, not only the frequency components of driving signals generated in the driving circuit can be dispersed and unnecessary radiation can be reduced, but also the timing for loading can be shifted for each plurality of circuit groups, thereby achieving further reduction of unnecessary radiation.

According to the present invention as described above, it becomes possible to obtain a driving circuit capable of dispersing frequency components of a driving signal for driving a display apparatus, such as a liquid crystal display apparatus, thereby reducing unnecessary radiation; a liquid crystal display apparatus equipped with such a driving circuit; and an electronic information device including such a liquid crystal display apparatus.

These and other advantages of the present invention will become apparent to those skilled in the art upon reading and understanding the following detailed description with reference to the accompanying figures.

Figure 1:
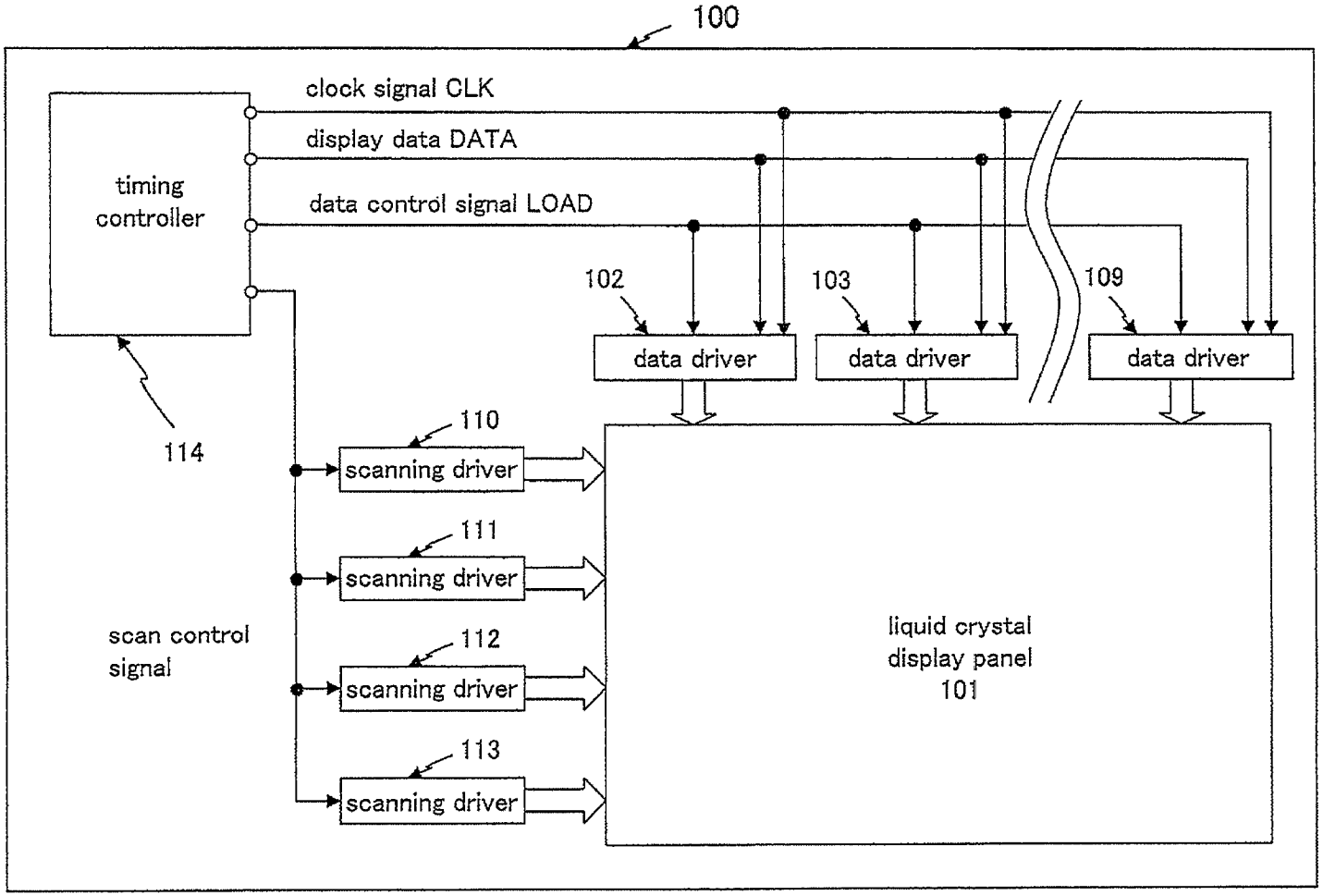
FIG. 1 is a diagram showing a configuration of a display apparatus including a driving circuit according to Embodiment 1 of the present invention.

14*a* control section
14*b*, 120, 120*b*, 220, D delay circuit
20*a*1-20*am* circuit block
24*a*1-24*am*, 24*b*1-24*bm* block delay circuit
100, 100*a*, 100*b*, 200 liquid crystal display apparatus
101, 201, 901 liquid crystal display panel
102-109, 102*a*-109*a*, 102*b*-109*b*, 202-209 LS1 data driver
110-113, 210-213 scanning driver
114, 114*a*, 214 timing controller
115, 215, 923 shift register section
115-1 to 115-*n*, 215-1 to 215-*k* shift register
116, 216, 924 latch circuit section
116-1 to 116-*n*, 216-1 to 216-*n* latch circuit
117, 217, 925 hold circuit section
117-1 to 117-*n*, 217-1 to 217-*k* hold circuit
118, 218, 926 D/A converter section
118-1 to 118-*n*, 218-1 to 218-*k* D/A converter
119, 219, 927 output buffer section
119-1 to 119-*n*, 219-1 to 219-*k* output buffer
121, 221 reference voltage correcting circuit
122, 222, 902 clock input terminal
123, 223, 903 data input terminal
124, 224, 904 control input terminal
125-129, 225-229, 905-909 reference voltage input terminal
130, 230, 911 output terminal section
130-1 to 130-*n* output terminal
131, 231 counter
132, 232 decoder
133-1 to 130-4 switch
134*a*, 134*b*, 134*c* delay section
De delay element

DESCRIPTION OF THE PREFERRED EMBODIMENTS

Hereinafter, embodiments of the present invention will be described.

(Embodiment 1)

FIG. 1 is a diagram showing a configuration of a liquid crystal display apparatus including a driving circuit according to Embodiment 1 of the present invention.

A liquid crystal display apparatus 100 according to Embodiment 1 includes a liquid crystal display panel 101 for performing image display based on a video signal, a plurality of data drivers 102 to 109 for driving a data signal line of the liquid crystal display panel, a plurality of scanning drivers 110 to 113 for driving a scan signal line of the liquid crystal display panel, and a timing controller 114 for generating display data, a data control signal and a scan control signal from a video signal, for controlling the data drivers 102 to 109 with the display data and the data control signal, and for controlling the scanning drivers 110 to 113 with the scan control signal.

More particularly, the data drivers 102 to 109 are connected to the data signal line of the liquid crystal display panel 101, and drives the data signal line based on the display data and data control signal from the timing controller 114. The data drivers 102 to 109 are formed by implementing a driver chip as an implementation structure such as a COF (Chip On Film) constituted of a semiconductor integrated circuit on a film substrate. The scanning drivers 110 to 113 are connected to the scan signal line of the liquid crystal display panel 101, and drives the scan signal line with the scan control signal from the timing controller 114. The scanning drivers 110 to 113 are also formed by implementing a driver chip as an implementation structure such as a COF (Chip On Film) constituted of a semiconductor integrated circuit on a film substrate. The timing controller 114 is connected through a signal line to at least one of the data drivers 102 to 109 and to at least one of the scanning drivers 110 to 113. By controlling at least one of the data drivers 102 to 109 and at least one of the scanning drivers 110 to 113, the timing controller 114 displays video data on the liquid crystal display panel 101. In summary, the timing controller 114 may be directly connected with each data driver and each scanning driver through a data bus. Alternatively, the timing controller 114 may be connected to a first stage data driver and a first stage scanning driver, and signals from the timing controller 114 may be transmitted to the data drivers and scanning drivers in the following stages from the first stage data driver and the first stage scanning driver.

Figure 2:
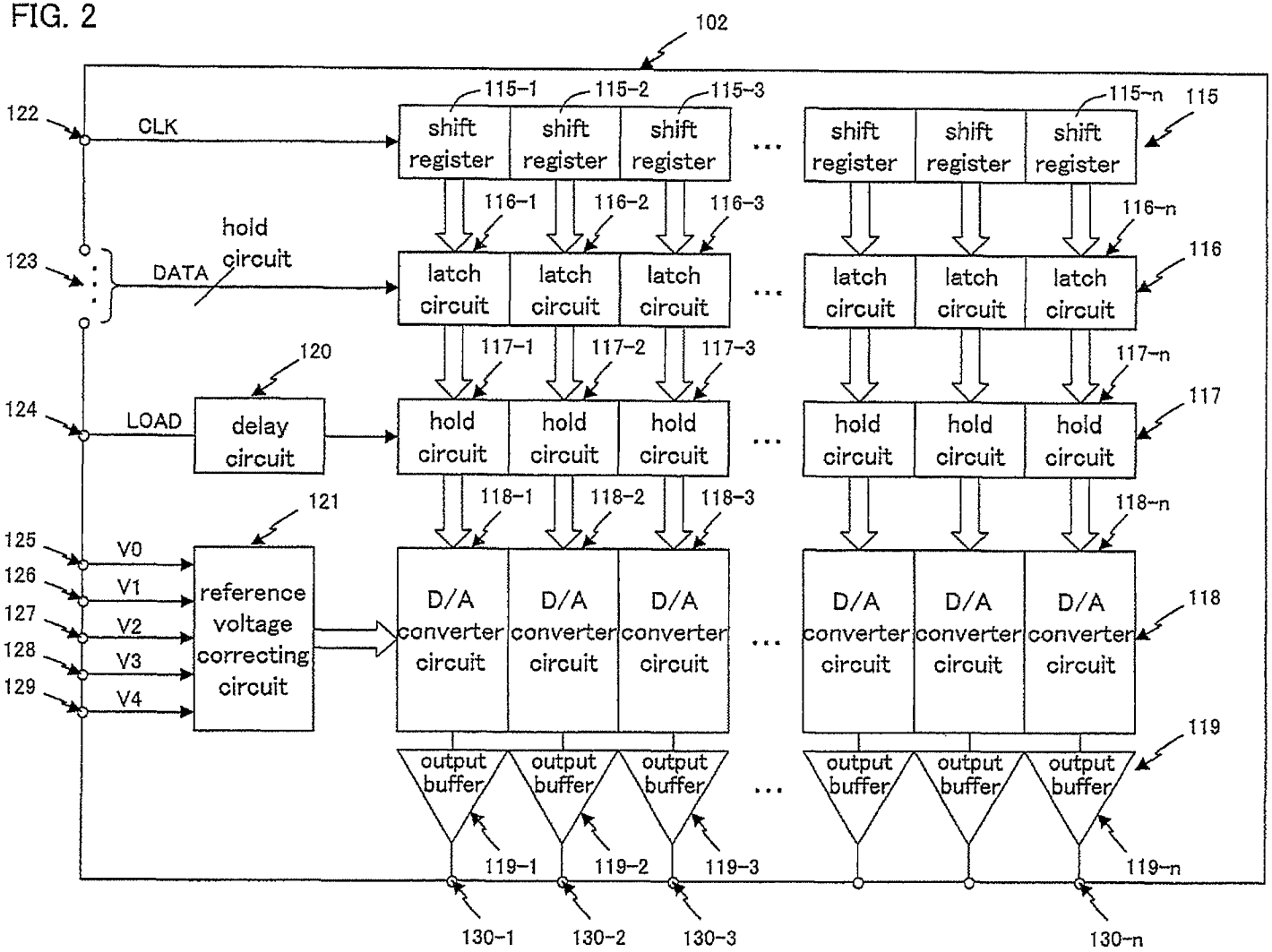
FIG. 2 is a block diagram showing a data driver, which is a driving circuit according to Embodiment 1 of the present invention.

FIG. 2 is a diagram showing a configuration of the data driver 102. The data drivers 103 to 109 each include the same configuration as the data driver 102, and thus the explanatory description for them will be omitted.

As shown in FIG. 2, the data driver 102 includes a pointer shift register circuit section 115 for performing a shift operation based on a clock signal CLK, a latch circuit section 116 for latching and sampling display data DATA, a hold circuit section 117 for latching and holding latched-and-sampled display data, a D/A converter section 118 for performing a D/A conversion on latched-and-held display data, and an output buffer section 119 for outputting display data subject to D/A conversion.

Herein, the pointer shift register circuit section 115 includes n stages of shift registers 115-1 to 115-*n*. The latch circuit section 116 includes n latch circuits 116-1 to 116-*n*. The hold circuit section 117 includes n hold circuits 117-1 to 117-*n*. The D/A converter 118 includes n D/A converter circuits 118-1 to 118-*n*. The output buffer section 119 includes n output buffers 119-1 to 119-*n*, each constituted of an operational amplifier.

The data driver 102 further includes a delay circuit 120 for delaying a data control signal, and a reference voltage correcting circuit 121 for generating m types of gradation voltages based on reference voltages V0 to V4 to be input.

As for input terminals, the data driver 102 further includes a clock input terminal 122, a display data input terminal 123, a control signal input terminal 124, and reference voltage terminals 125 to 129.

As for output terminals provided for signal outputting to the liquid crystal display panel 101, the data driver 102 further includes n signal output terminals 130-1 to 130-*n*. The signal output terminals 130-1 to 130-*n* are individually connected to the data signal line of the aforementioned liquid crystal display panel 101.

Herein, the clock input terminal 122 is provided to input a clock signal CLK given to the pointer shift register circuit section 115. The display data input terminal 123 consists of a plurality of signal input terminals corresponding to respective bits of gradation data of a plurality of bits. The control signal input terminal 124 is connected to the hold circuit section 117 through the delay circuit 120, and provided for allowing a data load signal LOAD to be input. The data load signal is used as a control signal for allowing the hold circuit section 117 to retain display data latched at the latch circuit section 116. The reference voltage terminals 125 to 129 each are provided for inputting reference voltages V0 to V4 given to the reference voltage correcting circuit 121.

The signal output terminals 130-1 to **130-*n* are provided for outputting gradation voltages output from the n output buffers 119-1 to 119-*n*, which constitute the output buffer section 119, to the liquid crystal display panel 101**.

Next, the operation of the apparatus described above will be described.

In the liquid crystal display apparatus 100 according to Embodiment 1, upon the input of a video signal from the outside, the timing controller 114 generates a display data DATA, a data control signal LOAD, a scan control signal and a clock signal CLK, from the video signal. When the display data DATA, the data control signal LOAD, and the clock signal CLK are supplied to the data drivers 102 to 109, the data drivers 102 to 109 drive the data signal line based on the display data and data control signal. Additionally, when the scan control signal is supplied to the scanning drivers 110 to 113, the scanning drivers 110 to 113 drive the scan signal line based on the scan control signal. Thereby, an image is displayed on the liquid crystal display panel in accordance with the video signal.

In the meantime, in the data driver 102, when the display data DATA, the data control signal LOAD, and the clock signal CLK from the timing controller 114 are supplied to the respective input terminals, the pointer shift register circuit section 115 shifts the clock signal CLK input in the clock input terminal 122, with the respective stages of shift registers 115-1 to **115-*n*, to output a latch circuit selection signal from the shift register of each stage. In summary, with the latch circuit selection signal, the pointer shift register circuit section 115 consecutively selects a first stage latch circuit 116-1 to an nth stage latch circuit 116-*n*, which constitute the latch circuit section 116**.

Upon the input of the latch circuit selection signal, the n latch circuits 116-1 to **116-*n* in the latch circuit section 116 change to an active state which allows storage of the display data DATA input from the display data input terminal 123. In this state, it is possible to store data of different values in the latch circuits 116-1 to 116-*n*. Therefore, when n clocks of the clock signal are input into the pointer shift register circuit section 115, all of the latch circuits 116-1 to 116-*n* can store display data corresponding to the respective data lines. When the display data DATA is input from the display data input terminal 123 in a state where each latch circuit can store data, a value of the display data DATA corresponding to each data line is selected and stored in each of the corresponding latch circuits 116-1 to 116-*n***.

N numbers of the hold circuits 117-1 to **117-*n* collectively retrieve and retain data stored in the corresponding latch circuits 116-1 to 116-*n* at the timing when the load signal (data control signal) LOAD becomes active (e.g., H level). The data retained in the hold circuits 117-1 to 117-*n* is changed into digital data input in the D/A converters 118-1 to 118-*n***.

At this stage, the data control signal LOAD is output from the timing controller 114 and input into the control signal input terminal 124 through a signal line, and subsequently, the data control signal LOAD is input into the hold circuit section 117 through the delay circuit 120. Thus, the data control signal LOAD is delayed for a predetermined time in the delay circuit 120 and is then input into the hold circuit section 117.

The D/A converters 118-1 to **118-*n* select and output one of the gradation voltages of p types, which is input from the reference voltage correcting circuit 121, based on the digital data described above. The details of such D/A converters 118-1 to 118-*n*** are described in Japanese Laid-Open Publication No. 2003-130921, for example, and thus the explanation for them will be omitted.

The output buffers 119-1 to **119-*n* perform an impedance conversion on, and output, the gradation voltages output from the respective D/A converters 118-1 to 118-*n*. The gradation voltages output from the output buffers 119-1 to 119-*n* are output to the corresponding data signal lines of the liquid crystal display panel 101, as gradation data (driving data), from respective signal output terminals 130-1 to 130-*n***.

While the operation explained above is that of the data driver 102, the rest of the data drivers 103 to 109 are operated in the same manner as the data driver 102.

Next, the delay circuit 120 in a driving circuit (data driver) 102 according to Embodiment 1 will be described in detail.

Figure 3:
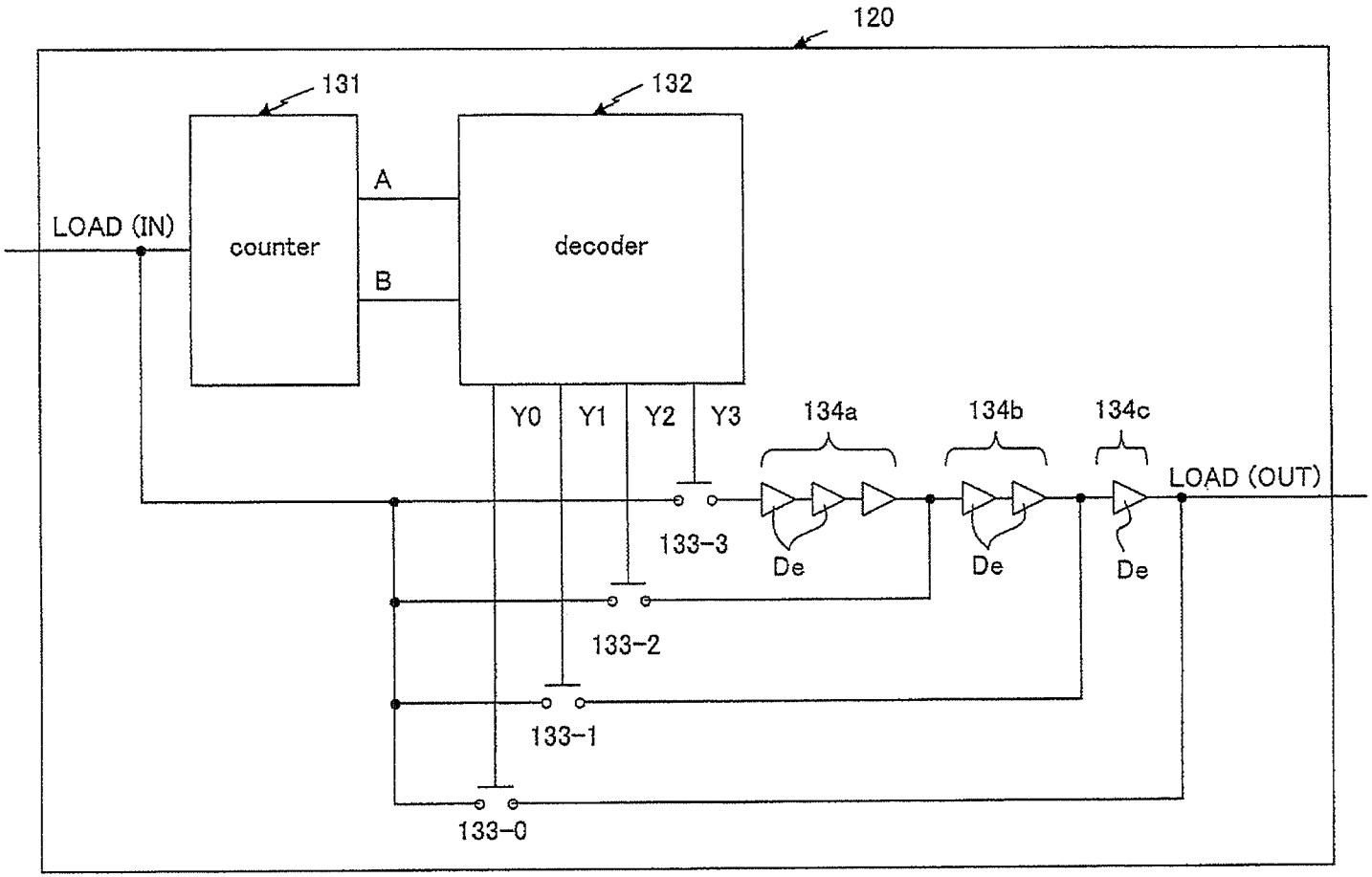
FIG. 3 is a block diagram showing a delay circuit constituting a driving circuit (data driver) according to Embodiment 1 of the present invention.

FIG. 3 is a block diagram showing a delay circuit constituting a driving circuit (data driver) 102 according to Embodiment 1.

The delay circuit 120 includes a 2 bit counter 131 connected to a control input terminal 124, a 4 output decoder 132 for decoding an output of the counter 131, four switches 133 (133-0 to 133-3) connected to the decoder 132, and a delay element De connected to the switches 133.

More particularly, the delay circuit 120 includes first to fourth switches 133-0 to 133-3, a delay section **134*a* consisting of three delay elements connected in series, a delay section 134*b* consisting of two delay elements connected in series, and a delay section 134*c* consisting of one delay element. The fourth switch 133-3 and the delay sections in the order of 134*a* to 134*c* are connected in series from the side of the input node and lie in between an input node (control input terminal 124) and an output node of the delay circuit 120**.

Herein, the third switch 133-2 is connected in parallel to the series connection body of the fourth switch 133-3 and the delay section **134*a*. The second switch 133-1 is connected in parallel to the series connection body of the fourth switch 133-3, the delay section 134*a* and the delay section 134*b*. The first switch 133-0 is connected in parallel to the series connection body of the fourth switch 133-3, the delay section 134*a*, the delay section 134*b* and the delay section 134*c***.

In the delay circuit 120 as described above, the counter 131 counts the number of pulses of the control signal LOAD(IN) (see FIG. 4) as a pulse signal input from the outside to the control input terminal 124. The decoder 132 turns outputs Y0 to Y3 thereof into an active state consecutively in accordance with the count number. The control signal herein is a pulse signal in synchronism with a horizontal synchronization signal of a video signal. Therefore, the first to fourth switches 133-0 to 133-3 are consecutively switched to be on every time one horizontal synchronization period elapses, and the switching of the switches is repeated for every four horizontal synchronization periods.

In summary, according to the count number, the path for the control signal LOAD is switched to one of the path through the three delay sections **134*a* to 134*c*, the path through the two delay sections 134*b* and 134*c*, the path through the delay section 134*c*, and the path through no delay section. Through such a path in accordance with the count number, the control signal LOAD is subsequently input into the hold circuit 117**.

Therefore, the control signal which has passed through the first switch 133-0 is output from an output node without delay. The control signal which has passed through the second switch 133-1 is output through one delay element De. The control signal which has passed through the third switch 133-2 is output through three delay elements De. The control signal which has passed through the fourth switch 133-3 is output through six delay elements De.

Figure 4:
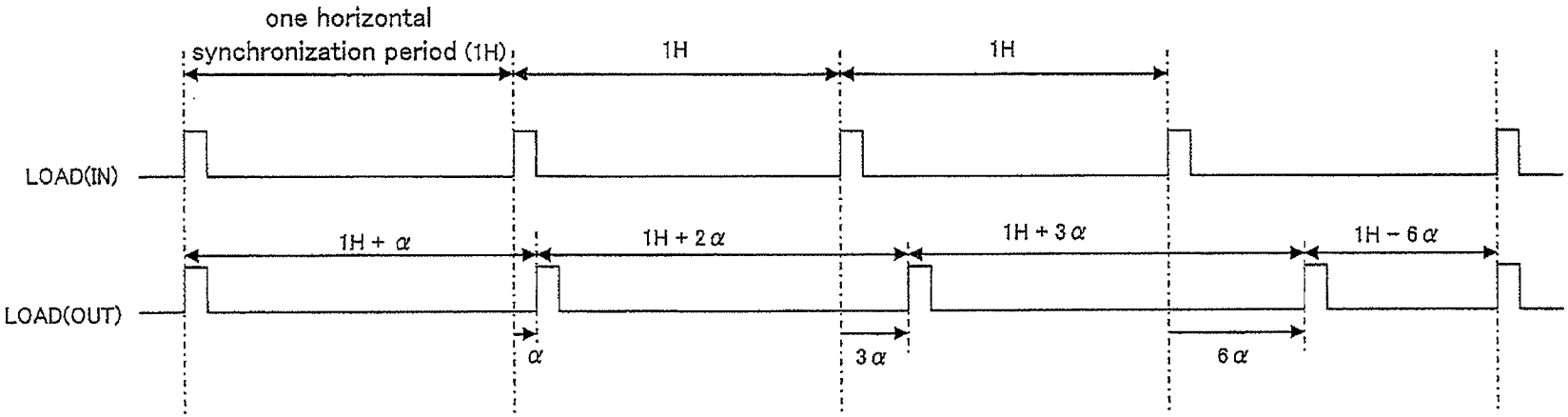
FIG. 4 is a diagram describing an operation of a delay circuit according to Embodiment 1 of the present invention, showing a delayed load signal (control signal) in a timing diagram.

Thus, with one horizontal synchronization period defined to be 1H and a delay period of time by one delay element De defined to be α, the timing for the pulse rise of the control signal LOAD, which is input in the hold circuit section 117, is delayed by a delay period of time 1H+α, 1H+2α, 1H+3α or 0 for each horizontal period with respect to the timing determined by a fixed cycle with one horizontal synchronization period as a reference. In other words, each pulse in the control signal rises after the elapse of the time 1H+α, 1H+2α, 1H+3α and 1H−6α from the pulse rise timing immediately before, and it can be said that there are four types of cycles such as 1H+α, 1H+2α, 1H+3α and 1H−6α, as shown in FIG. 4.

As a result, the frequency of the control signal in the data driver circuit is dispersed, thereby reducing unnecessary radiation.

According to Embodiment 1 as described above, the data drivers (driving circuits) 102 to 109, which drives the liquid crystal display panel 101 based on the display data and the control signal, include the delay circuit 120 for delaying input control signal as well as the hold circuit section 117, the D/A converter circuit section 118 and the output buffer section 119, as a data load section for loading input display data to the liquid crystal display panel 101 at the timing generated by the delayed control signal. Further, the delay circuit 120 delays the control signal in such a manner that the load timing at which the display data is loaded to the liquid crystal display panel 101 varies with reference to a fixed timing determined by a constant cycle (one horizontal synchronization period). Therefore, it becomes possible to vary the output timing, at which the driving circuit loads data, periodically for each horizontal synchronization period. Thereby, it becomes possible to disperse frequency components of the display data output to the liquid crystal display panel and reduce unnecessary radiation.

In Embodiment 1, the output timing at which the driving circuit loads data is varied periodically for each horizontal synchronization period; however, the output timing at which the driving circuit loads data may be varied periodically for each of two or more horizontal synchronization periods.

(Embodiment 2)

Figure 5:
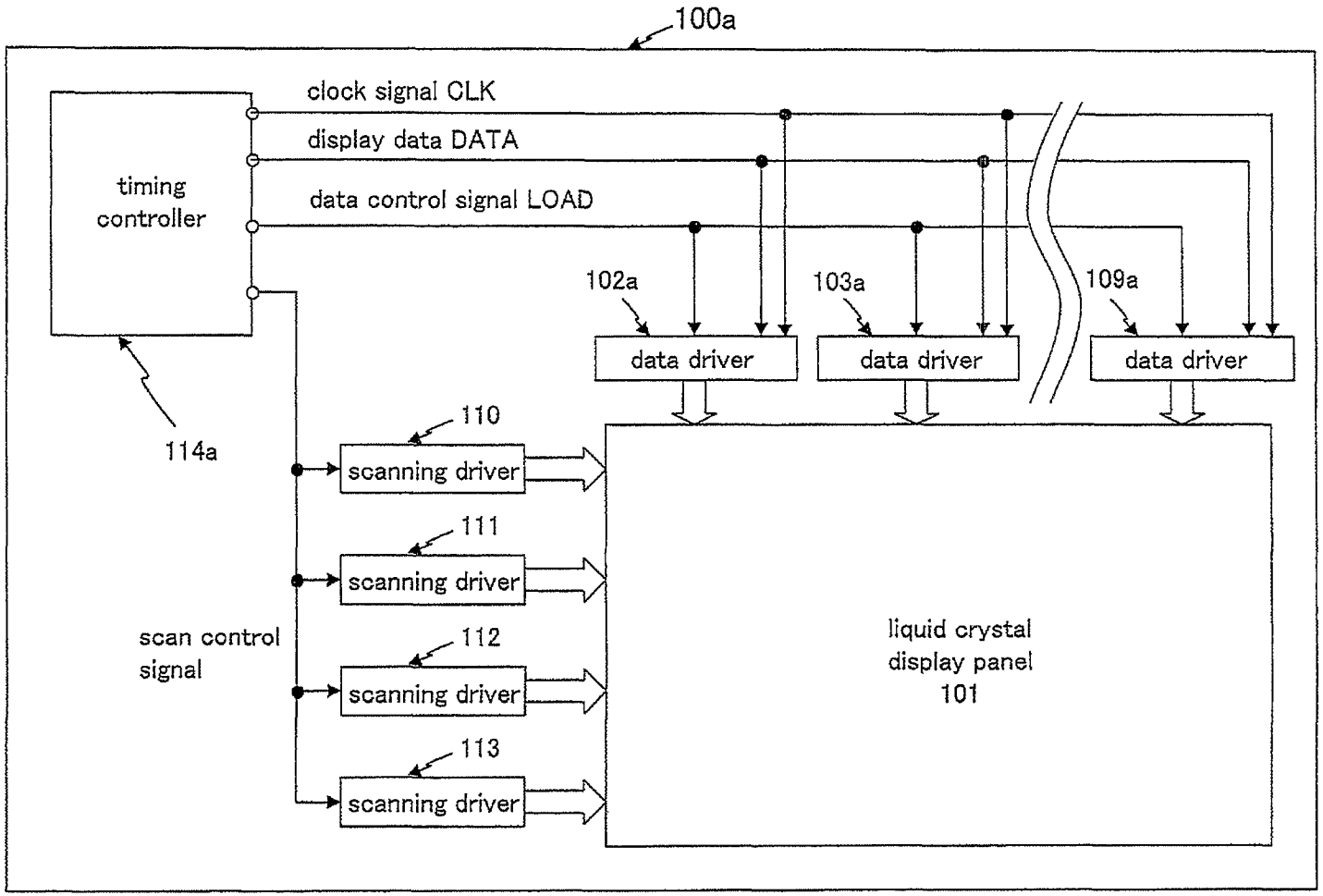
FIG. 5 is a diagram showing a configuration of a display apparatus including a timing controller according to Embodiment 2 of the present invention.

FIG. 5 is a diagram showing a configuration of a liquid crystal display apparatus including a timing controller according to Embodiment 2 of the present invention.

A liquid crystal display apparatus 100*a* according to Embodiment 2 includes a timing controller 114*a* equipped with a delay circuit 14*b*, which has the same configuration as the delay circuit 120 in Embodiment 1, instead of the timing controller 114 in the liquid crystal display apparatus 100 according to Embodiment 1. In the liquid crystal display apparatus 100*a* according to Embodiment 2, data drivers 102*a*, 103*a* and 109*a* have the same configuration as that of the conventional data driver 901. The rest of the configuration in the liquid crystal display apparatus 100*a* according to Embodiment 2 is the same as that of the liquid crystal display apparatus 100 according to Embodiment 1.

Figure 6:
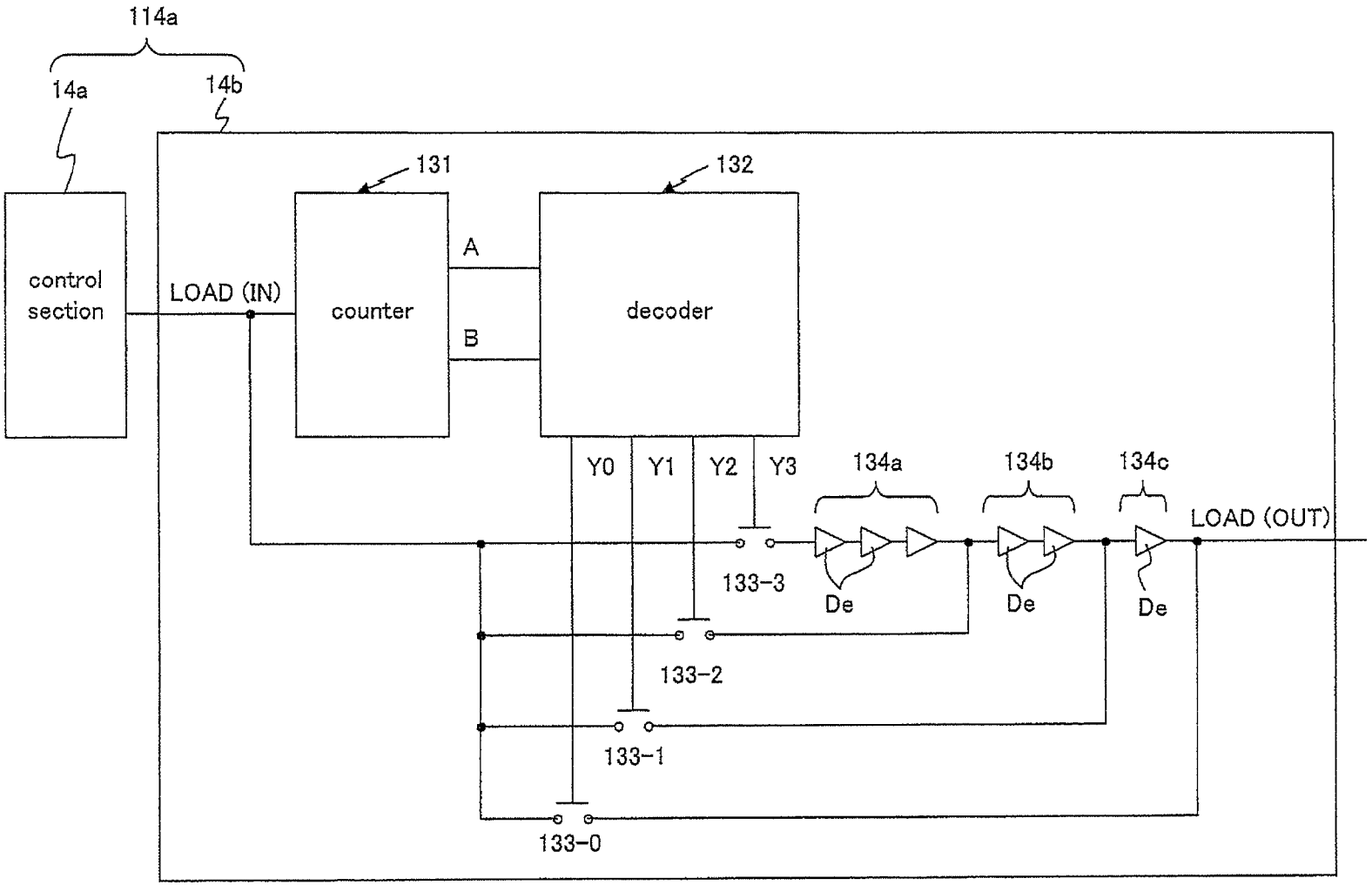
FIG. 6 is a block diagram showing a timing controller according to Embodiment 2 of the present invention.

FIG. 6 is a diagram showing a timing controller according to Embodiment 2 of the present invention.

The timing controller 114*a* according to Embodiment 2 includes a control section 14*a* for generating a display data, a data control signal, a clock signal and a scan control signal, based on a video signal supplied from outside the liquid crystal display apparatus 100*a*, and a delay circuit 14*b* for delaying a data control signal LOAD output from the control section 14*a*. The delay circuit 14*b* has the same configuration as the delay circuit 120 included in the data driver 102 according to Embodiment 1.

In the liquid crystal display apparatus 100*a* according to Embodiment 2 with the configuration described above, the timing controller 114*a* is configured to include the delay circuit 14*b* for delaying a data control signal. Therefore, the control signal supplied from the delay circuit 14*b* to data drivers (driving circuits) 102*a* to 109*a* is delayed in such a manner that the load timing at which the display data is loaded to the display apparatus varies according to fixed timing determined by a constant cycle (one horizontal synchronization period). As a result, it becomes possible to vary the output timing, at which the driving circuit loads data to the liquid crystal display panel, periodically for each horizontal synchronization period. Thereby, it becomes possible to disperse frequency components of the display data output to the liquid crystal display panel and reduce unnecessary radiation.

(Embodiment 3)

Figure 7:
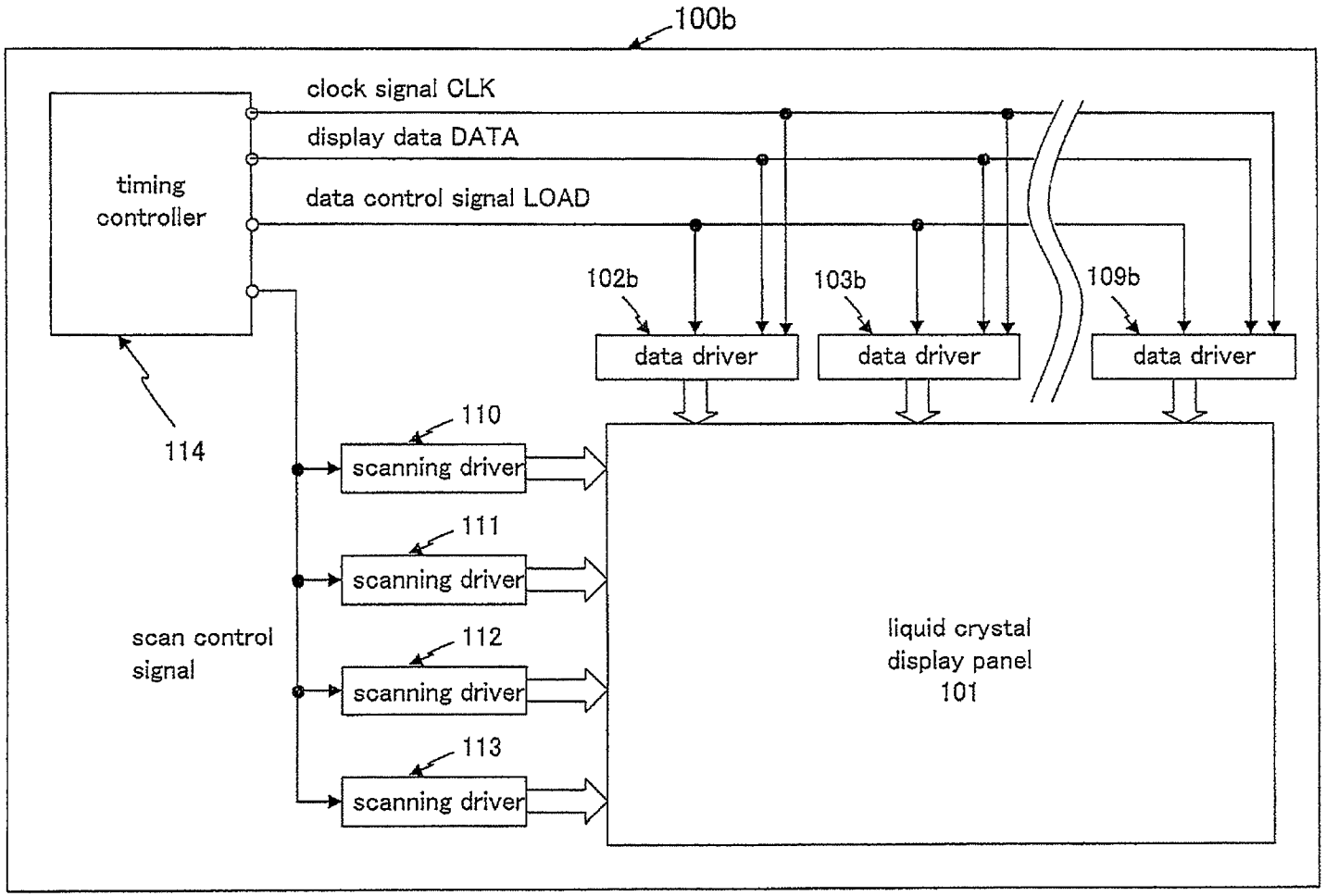
FIG. 7 is a diagram showing a configuration of a display apparatus including a driving circuit according to Embodiment 3 of the present invention.
Figure 8:
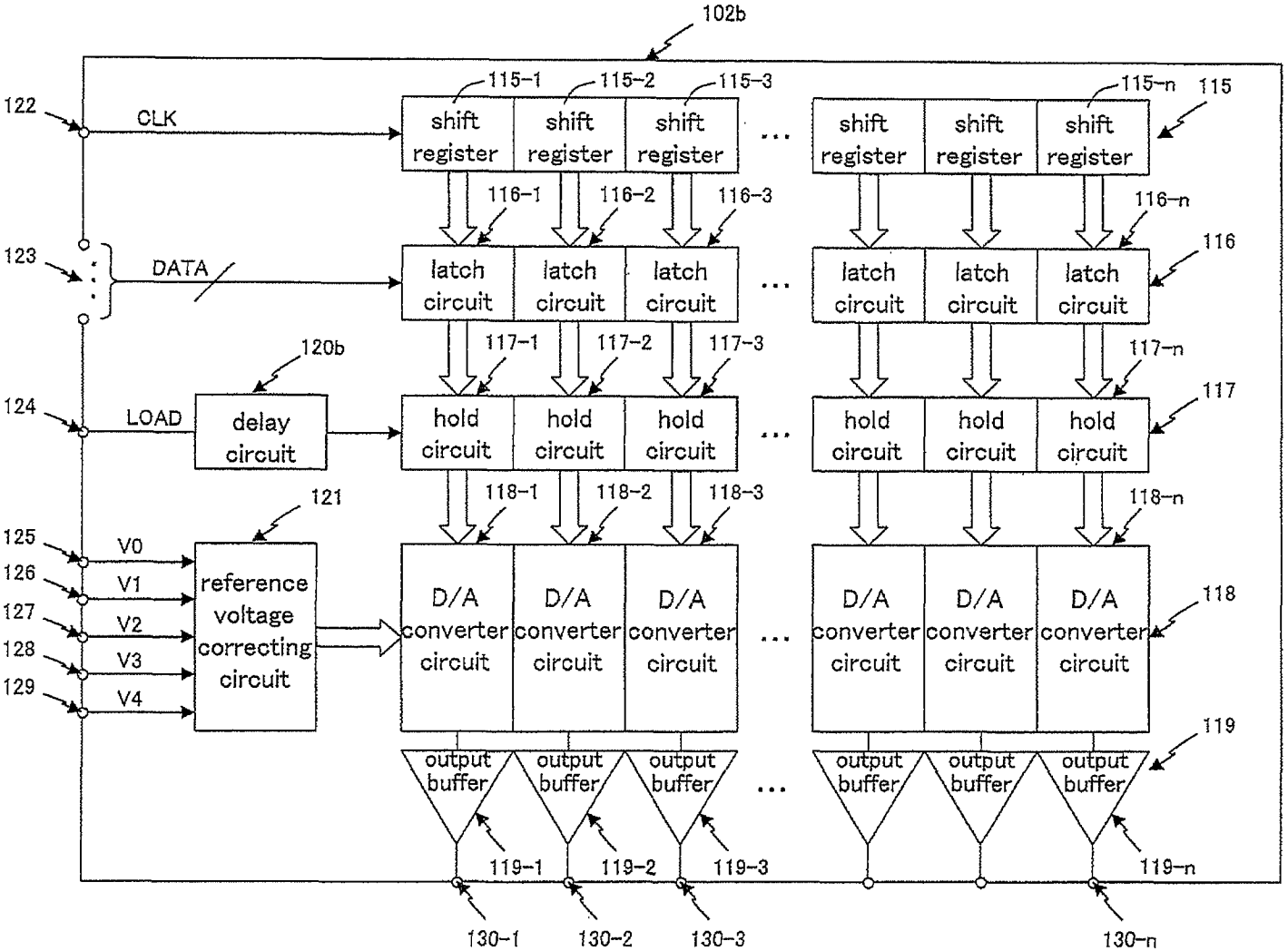
FIG. 8 is a block diagram showing a data driver, which is a driving circuit according to Embodiment 3 of the present invention.

FIG. 7 is a diagram showing a configuration of a liquid crystal display apparatus including a driving circuit according to Embodiment 3 of the present invention. FIG. 8 is a diagram showing a data driver, which is a driving circuit according to Embodiment 3 of the present invention.

A liquid crystal display apparatus 100*b* according to Embodiment 3 includes data drivers 102*b* to 109*b* each including a delay circuit 120*b* with a circuit configuration different from that of the delay circuit 120, instead of the data drivers 102 to 109 with the delay circuit 120 in the liquid crystal display apparatus 100 according to Embodiment 1. The rest of the configuration in the liquid crystal display apparatus 100*b* according to Embodiment 3 is the same as that of the liquid crystal display apparatus 100 according to Embodiment 1.

Figure 9:
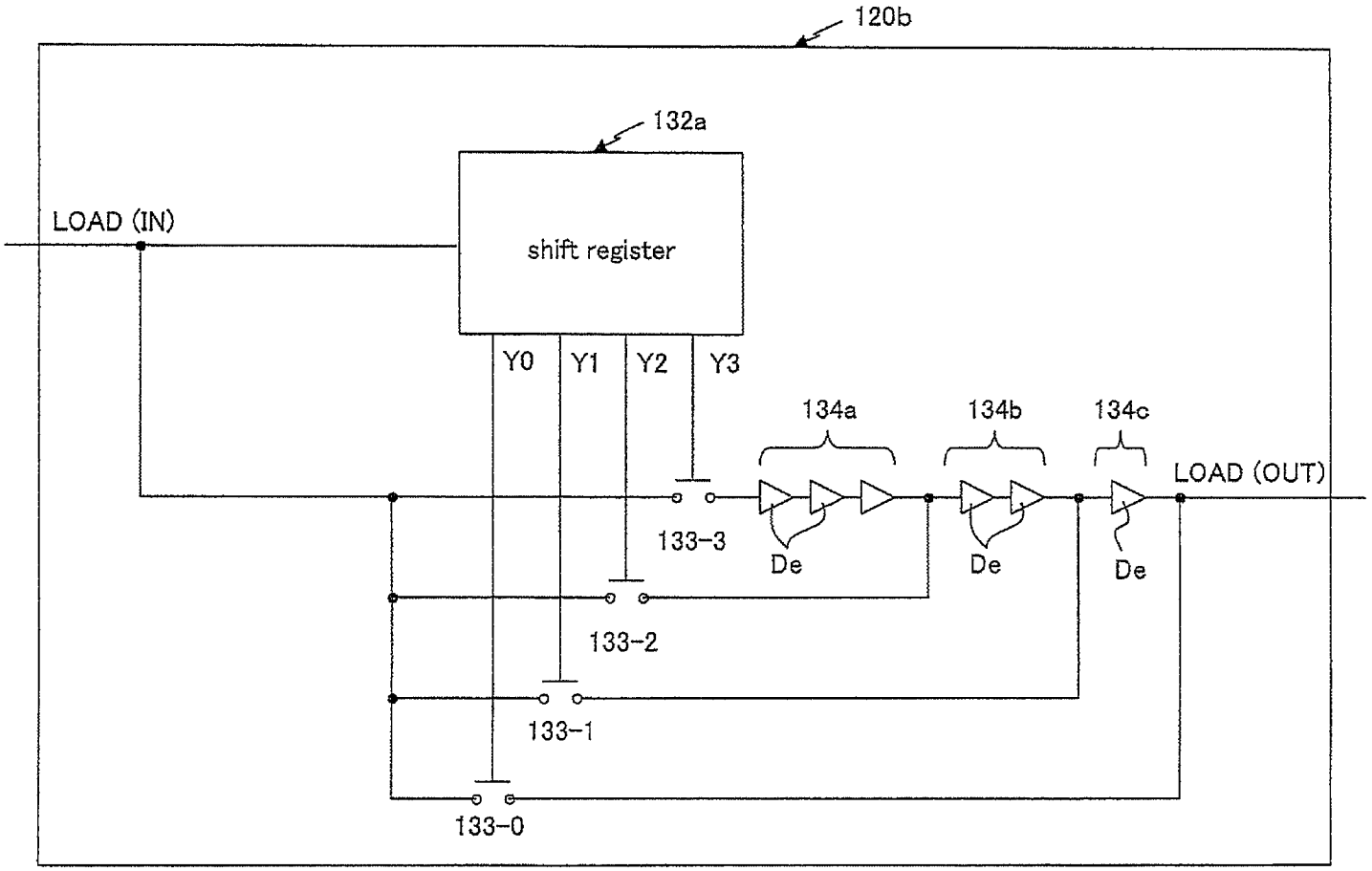
FIG. 9 is a block diagram showing a delay circuit constituting a driving circuit (data driver) according to Embodiment 3 of the present invention.

FIG. 9 is a block diagram showing a delay circuit 120*b* constituting a driving circuit (data driver) according to Embodiment 3 of the present invention.

The delay circuit 120*b* includes a shift register 132*a* instead of the counter 131 and the decoder 132 in the delay circuit 120, which constitutes the data driver 102 according to Embodiment 1. The rest of the configuration is the same as that of the delay circuit 120 in Embodiment 1.

In summary, the delay circuit 120*b* in the data driver 102*b* according to Embodiment 3 includes a shift register 132*a* for performing a shift operation based on fixed timing generated from a input control signal LOAD, a plurality of delay elements De connected in series, and a plurality of switches 133-0 to 133-3 for switching signal paths of the control signal based on the output of the shift register in such a manner that the control signal is delayed by a predetermined number of delay elements which are connected in series among the plurality of delay elements. The delay elements De and the switches 133-0 to 133-3 are identical to those in the delay circuit 120 according to Embodiment 1.

In the delay circuit 120*b* with the configuration described above, the shift register 132*a* turns outputs Y0 to Y3 thereof into an active state consecutively every time the pulse of the control signal LOAD (IN) (see FIG. 4) rises, the control signal LOAD (IN) being a pulse signal input from the outside to the control input terminal 124. The control signal herein is a pulse signal in synchronism with a horizontal synchronization signal of a video signal. Therefore, the first to fourth switches 133-0 to 133-3 are consecutively switched to be on every time one horizontal synchronization period elapses, and the switching of the switches is repeated for every four horizontal synchronization periods.

Therefore, similar to the delay circuit 120 according to Embodiment 1, the control signal which has passed through the first switch 133-0 is output from an output node without delay. The control signal which has passed through the second switch 133-1 is output through one delay element De. The control signal which has passed through the third switch 133-2 is output through three delay elements De. The control signal which has passed through the fourth switch 133-3 is output through six delay elements De.

Thus, with one horizontal synchronization period defined to be 1H and a delay period of time by one delay element De defined to be α, the timing for the pulse rise of the control signal LOAD, which is input in the hold circuit section 117, is delayed for a delay period of time 1H+α, 1H+2α, 1H+3α or 0 for each horizontal period with respect to the timing determined by a fixed cycle with one horizontal synchronization period as a reference.

As a result, the frequency of the control signal in the data driver circuit is dispersed, thereby reducing unnecessary radiation.

(Embodiment 4)

Figure 10:
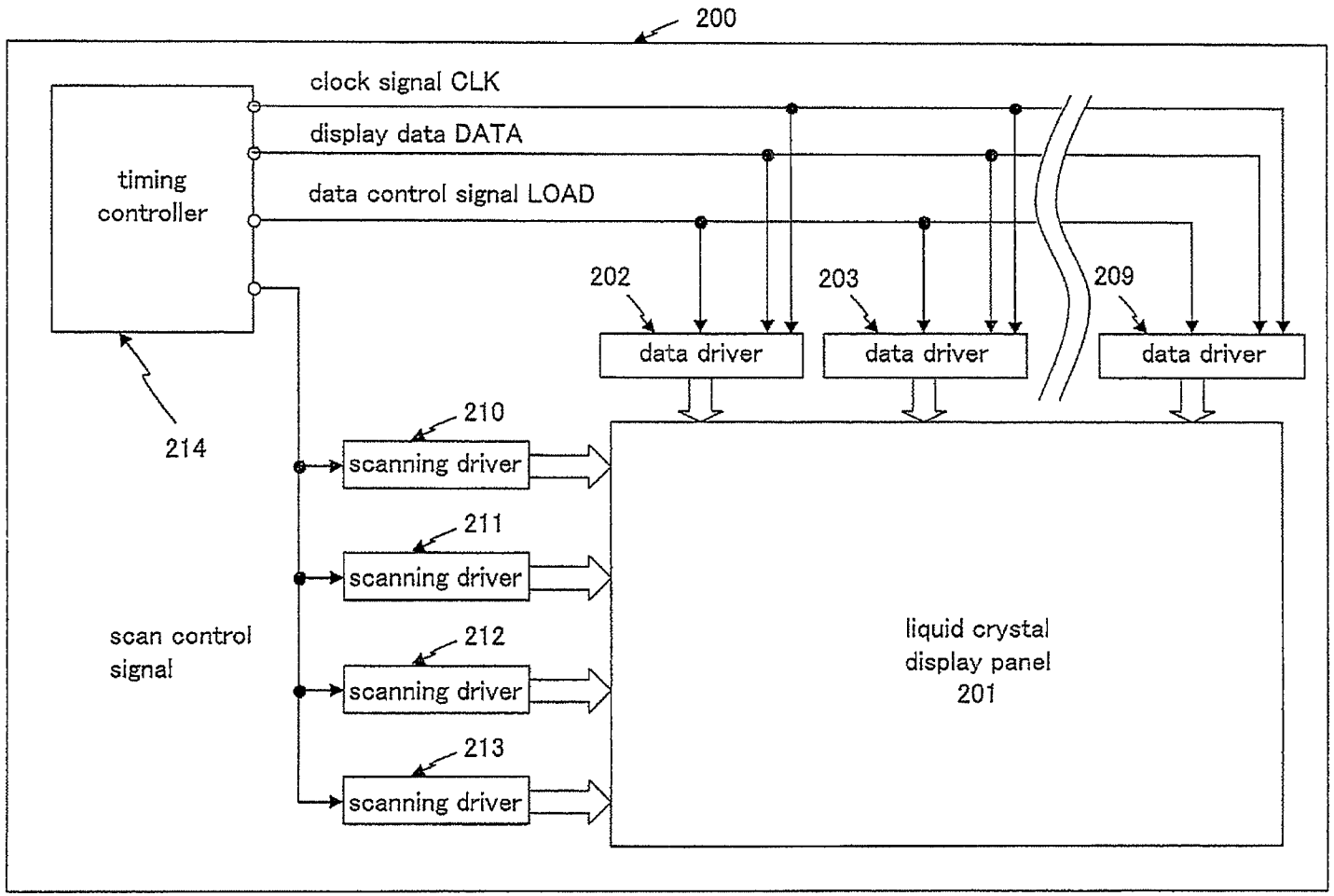
FIG. 10 is a diagram showing a configuration of a display apparatus including a driving circuit according to Embodiment 4 of the present invention.

FIG. 10 is a diagram showing a configuration of a display apparatus including a driving circuit according to Embodiment 4 of the present invention.

A liquid crystal display apparatus 200 according to Embodiment 4 includes data drivers 202 to 209, instead of the data drivers 102 to 109 in the liquid crystal display apparatus 100 according to Embodiment 1, the configuration of the data drivers 202 to 209 being different from that of the data drivers 102 to 109.

Figure 11:
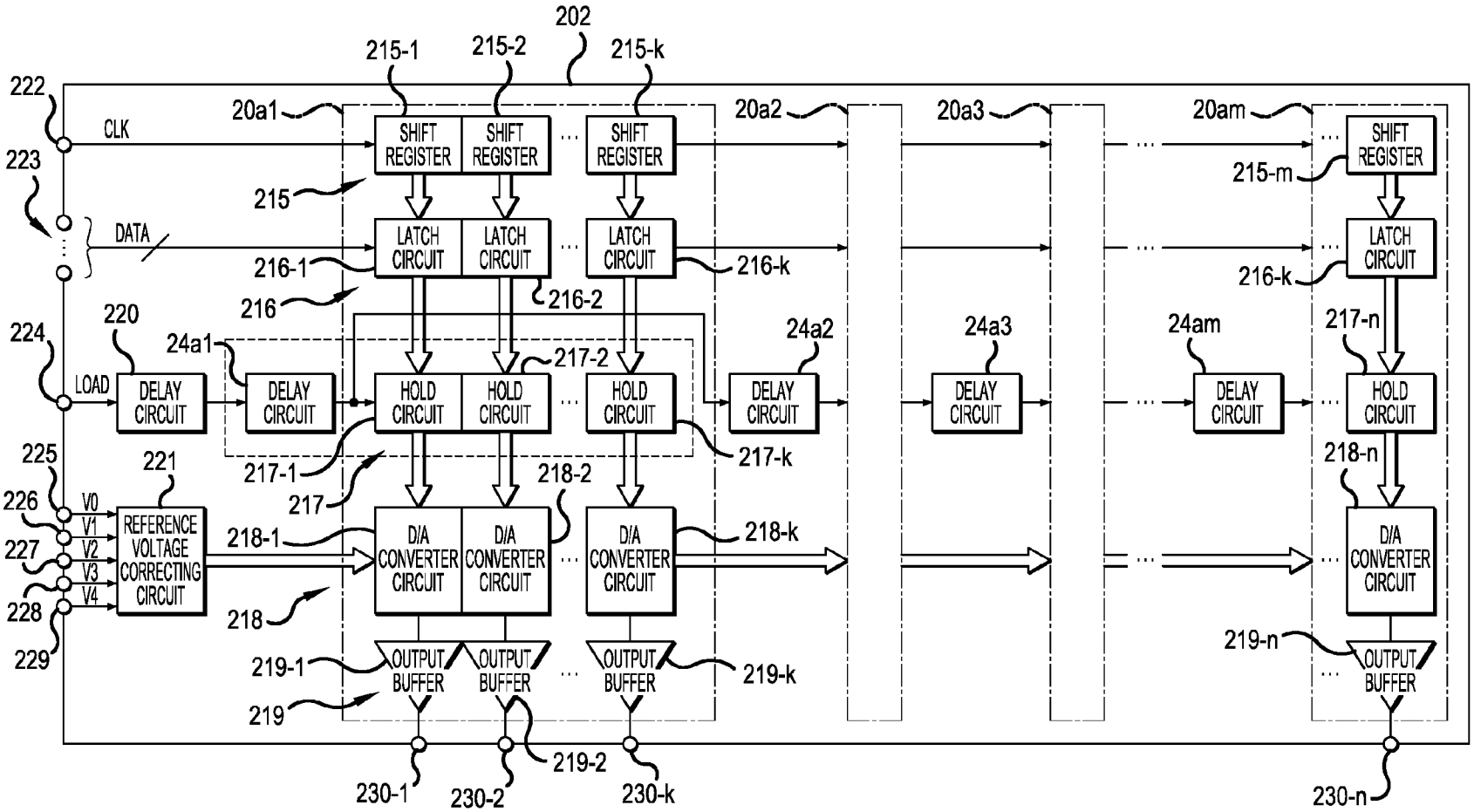
FIG. 11 is a block diagram showing a data driver, which is a driving circuit according to Embodiment 4 of the present invention.

FIG. 11 is a block diagram showing a data driver, which is a driving circuit according to Embodiment 4 of the present invention, showing a configuration of a data driver 202.

More particularly, in addition to the configuration of the data driver 102 according to Embodiment 1, the data driver 202 according to Embodiment 4 includes shift registers, latch circuits, hold circuits, D/A converter circuits, and buffer circuits, formed into a group of m groups 20*a*1 to 20*am*, for each data signal line of a predetermined number (k, herein) among all of n-numbered data signal lines. The data driver 202 further includes delay circuits 24*a*1 to 24*am* with a fixed delay period of time, each corresponding to the respective group, the delay circuits 21*a*1 to 24*am* being provided in the previous stage of the respective group.

The delay circuits 24*a*1 to 24*am* are connected in series so that control signals from a delay circuit 220 are delayed consecutively for a given period of time. The delay circuit 220 has the same configuration as the delay circuit 120 according to Embodiment 1 and is also capable of varying the delay amount. Outputs from the delay circuits 24*a*1 to 24*am* with a fixed delay amount and provided in the previous stage of each group, are supplied to each hold circuit in each of the groups 20*a*1 to 20*am*.

Therefore, a timing controller 214, scanning drivers 210 to 213, and a liquid crystal display panel 201 in the liquid crystal display apparatus 200 according to Embodiment 4 are identical to the timing controller 114, the scanning drivers 110 to 113, and the liquid crystal display panel 101 in the liquid crystal display apparatus 100 according to Embodiment 1.

In summary, the data drivers 202 to 209 are connected to a data signal line of the liquid crystal display panel 201, and drive the data signal lines. In addition, the data drivers 202 to 209 are formed by implementing a driver chip as an implementation structure such as a COF (Chip On Film) constituted of a semiconductor integrated circuit on a film substrate. The scanning drivers 210 to 213 are connected to a scan signal line of a display panel 201, and drives the scan signal lines. The scanning drivers 210 to 213 are also formed by implementing a driver chip as an implementation structure such as a COF (Chip On Film) constituted of a semiconductor integrated circuit on a film substrate. The timing controller 214 is connected to at least one of the data drivers 202 to 209 and to at least one of the scanning drivers 210 to 213, through a signal line. By controlling at least one of the data drivers 202 to 209 and at least one of the scanning drivers 210 to 213, the timing controller 214 causes the liquid crystal display panel 201 to display video data.

Hereinafter, the data driver 202 will be described.

The data drivers 203 to 209 each include the same configuration as the data driver 202, and thus the explanatory description for them will be omitted.

Similar to the data driver 102 according to Embodiment 1, the data driver 202 includes a pointer shifter register circuit section 215, a latch circuit 216, a hold circuit section 217, a D/A converter section 218 and an output buffer section 219.

In the data driver 202, however, shift registers 215-1 to 215-*n*, constituting the pointer shift register circuit section 215, are grouped to form a group for each k-numbered data signal lines. In addition, latch circuits 216-1 to 216-*n* constituting the latch circuit 216, hold circuits 217-1 to 217-*n* constituting the hold circuit section 217, D/A converters 218-1 to 218-*n* constituting the D/A converter section 218, and output buffers 219-1 to 219-*n* constituting the output buffer section 219 are grouped in a similar manner.

In summary, respective groups 20*a*1 to 20*am* each include shift registers 215-1 to 215-*k* constituting the pointer shift register circuit section 215, latch circuits 216-1 to 216-*k* constituting the latch circuit 216, hold circuits 217-1 to 217-*k* constituting the hold circuit section 217, D/A converters 218-1 to 218-*k* constituting the D/A converter section 218, and output buffers 219-1 to 219-*k* constituting the output buffer section 219.

The data driver 202 also includes a delay circuit 220 with a variable delay amount, and a reference voltage correcting circuit 221. As for input terminals, the data driver 202 further includes a clock input terminal 222, a display data input terminal 223, a control signal input terminal 224, and reference voltage terminals 225 to 229. In addition, as for output terminals provided for signal outputting to the liquid crystal display panel 201, the data driver 202 further includes n signal output terminals 230-1 to 230-*n*. The signal output terminals 230-1 to 230-*n* are individually connected to the data signal line of the aforementioned liquid crystal display panel 201.

The clock input terminal 222 is provided to input a clock signal CLK given to the pointer shift register circuit section 215. The display data input terminal 223 consists of a plurality of signal input terminals corresponding to respective bits of gradation data of a plurality of bits. The control signal input terminal 224 is connected to the hold circuit section 217 through the delay circuit 220 with a variable delay amount, and allows a control signal to be input. The control signal is used as a signal for allowing the hold circuit section 217 to retain display data latched at the latch circuit section 216. The reference voltage terminals 225 to 229 are respectively provided for inputting reference voltages V0 to V4 given to the reference voltage correcting circuit 221.

The signal output terminals 230-1 to 230-*n* are provided for outputting gradation voltages output from the output buffers 219-1 to 219-*n*, constituting the output buffer section 219, to the liquid crystal display panel 201.

Figure 12:
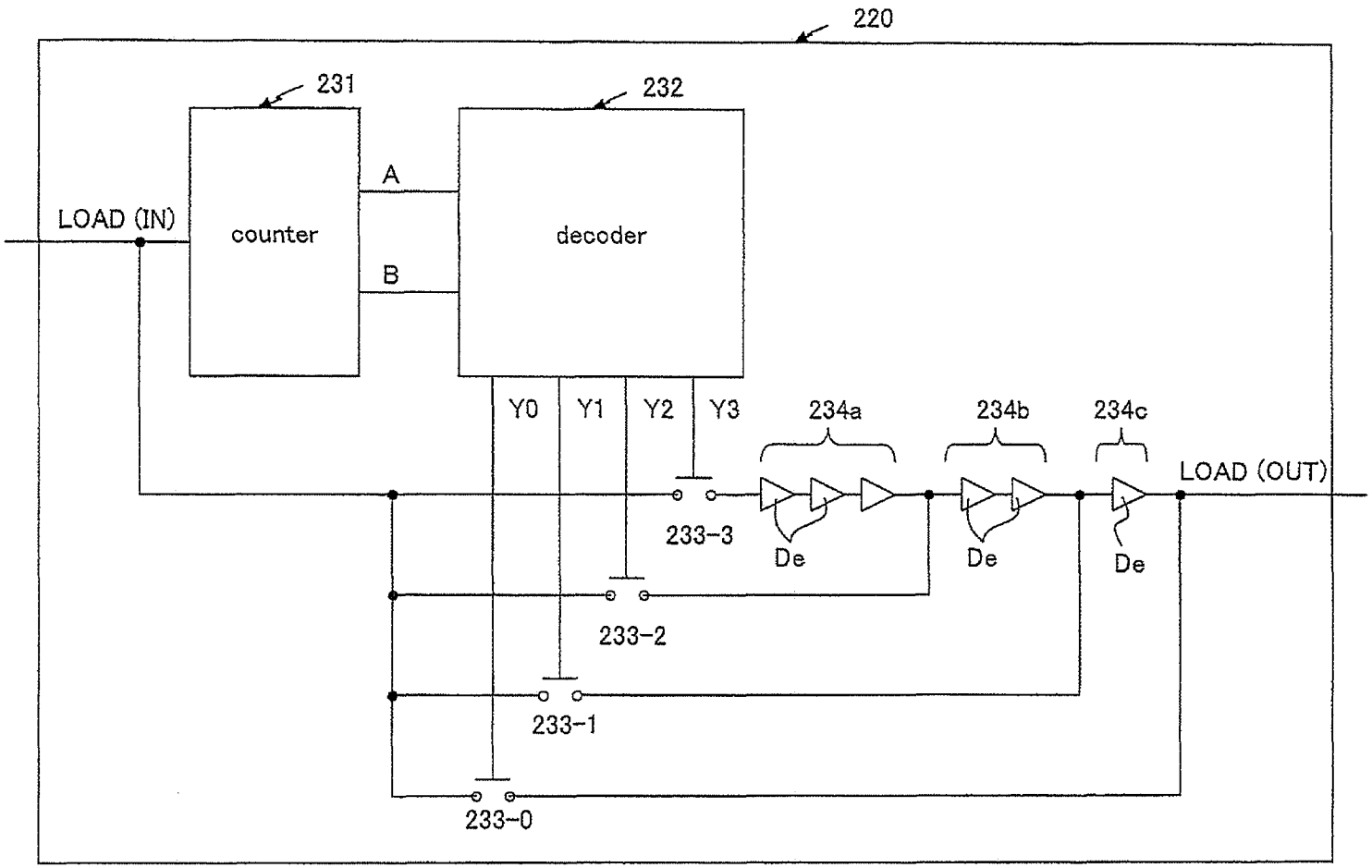
FIG. 12 is a block diagram showing a delay circuit constituting a driving circuit (data driver) according to Embodiment 4 of the present invention.

FIG. 12 is a block diagram showing a delay circuit with a variable delay amount, constituting a driving circuit (data driver) according to Embodiment 4.

The delay circuit 220 with a variable delay amount according to Embodiment 4 has the same configuration as the delay circuit 120 according to Embodiment 1 as shown in FIG. 3.

The delay circuit 220 is formed of a 2 bit counter 231 connected to a control input terminal 224, a 4 output decoder 232 connected to the counter 231, four switches 233 (233-0 to 233-3) connected to the decoder 232, and delay elements De connected to the switches 233. Herein, delay sections 234*a* to 234*c*, which include a 2 bit counter 231, a 4 output decoder 232, switches 233 and delay elements De, are identical to those in the delay circuit according to Embodiment 1.

Next, the operation of the apparatus described above will be described.

In the liquid crystal display apparatus 200 according to Embodiment 4, upon the input of a video signal from the outside, the timing controller 214 generates a display data DATA, a data control signal LOAD, a scan control signal and a clock signal CLK, from the video signal. When the display data DATA, the data control signal LOAD, and the clock signal CLK are supplied to the data drivers 202 to 209, the data drivers 202 to 209 drive the data signal line based on the display data and data control signal. Additionally, when the scan control signal is supplied to the scanning drivers 210 to 213, the scanning drivers 210 to 213 drive the scan signal line based on the scan control signal. Thereby, an image is displayed on the liquid crystal display panel in accordance with the video signal.

In the meantime, in the data driver 202, when the display data DATA, the data control signal LOAD, and the clock signal CLK from the timing controller 214 are supplied to respective input terminals, the pointer shift register circuit section 215 shifts the clock signal CLK input to the clock input terminal 222, with the respective stages of shift registers 215-1 to 215-*n*, to output a latch circuit selection signal from the shift register of each stage. With the latch circuit selection signal, the pointer shift register circuit section 215 consecutively selects a first stage latch circuit 216-1 to an nth stage latch circuit 216-*n*, which constitute the latch circuit section 216.

Upon the input of the latch circuit selection signal, the latch circuits 216-1 to 216-*n* turn into an active state which allows storage of the display data DATA input from the display data input terminal 223. In this state, it is possible to store data of different values in the latch circuits 216-1 to 216-*n*. Therefore, when n clocks of the clock signal are input to the pointer shift register circuit section 215, all of the latch circuits 216-1 to 216-*n* can store display data corresponding to respective data lines. When the display data DATA is input from the display data input terminal 223 in this state, the display data DATA is selected and stored in each of the corresponding latch circuits 216-1 to 216-*n*.

The hold circuit section 217 is constituted of n-numbered hold circuits 217-1 to 217-*n*, which are divided into a plurality of groups (m number). The number of groups is not particularly limited; however, there can be four or eight groups, to be specific.

In addition, the hold circuits of each divided group, which constitute the hold circuit section 217, are connected with delay circuits 24*a*1 to 24*am* with a fixed delay amount, in such a manner that the number of the delay circuits 24*a*1 to 24*am* with a fixed delay amount, through which the input control signal passes, is different in accordance with each group. As a result, the control signal can be delayed for a predetermined delay period of time for each hold circuit of each group.

The hold circuits 117-1 to 117-*n*, which constitute the hold circuit section 217, retrieve and retain data stored in the corresponding latch circuits 216-1 to 216-*n* at the timing when the control signal delayed for a predetermined delay period of time set for each group becomes active (e.g., H level), for each group. The data retained in the hold circuits 217-1 to 217-*n* is changed into digital data input in the D/A converters 218-1 to 218-*n*.

The control signal is output from the timing controller 214 and input into the control signal input terminal 224 through a signal line, and subsequently, the control signal is input into the hold circuit section 217 of each group (hold circuits 217-1 to 217-*k*) through the delay circuit 220 with a variable delay amount and delay circuits 24*a*1 to 24*am* with a fixed delay amount. Thus, the control signal is delayed for a predetermined time in the delay circuit 220 and the delay circuits 24*a*1 to 24*am* and is then input into the hold circuit section 217 of each group (hold circuits 217-1 to 217-*k*). Therefore, with regard to the control signal timing output from the timing controller 214, the data retrieval timing of the hold circuit section 217 of each group (hold circuits 217-1 to 217-*k*) is delayed for the total sum of the time delayed in the delay circuit 220 with a variable delay amount, and the time delayed in the predetermined number (the number corresponding to each group) of the delay circuits among the delay circuits 24*a*1 to 24*am* with a fixed delay amount.

In addition, the D/A converters 218-1 to 218-*n* select and output one of the gradation voltages of p types, which are input from the reference voltage correcting circuit 221, based on the digital data described above. The details of such D/A converters 218-1 to 218-*n* are described in Japanese Laid-Open Publication No. 2003-130921, for example, and thus the explanation for them will be omitted.

The output buffers 219-1 to 219-*n* perform an impedance conversion on the gradation voltages output from respective D/A converters 218-1 to 218-*n*. The gradation voltages are output from the output buffers 219-1 to 219-*n* to the liquid crystal display panel 201, as gradation data (driving data), from respective signal output terminals 230-1 to 230-*n*.

In addition, in the delay circuit 220 with a variable delay amount, signals input from the outside to the control input terminal 224 are counted by the counter 231, and the control signal is delayed at the delay element De in accordance with the count number and is input to the hold circuit section 217. At this stage, the control signal which has passed through the switch 233-0 is output from an output node without delay. The control signal which has passed through the switch 233-1 is output through one delay element De. The control signal which has passed through the switch 233-2 is output through three delay elements De. The control signal which has passed through the switch 233-3 is output through six delay elements De. Thus, with one horizontal synchronization period defined to be 1H and a delay period of time by one delay element De defined to be $\alpha$, there are four types of signal cycles which are input to the hold circuit section 217, such as $1H+\alpha$, $1H+2\alpha$, $1H+3\alpha$ and $1H-6\alpha$, as shown in FIG. 4.

As a result, the frequency of the control signal is dispersed, and furthermore, the data load timing is different for each group, thereby reducing unnecessary radiation even more.

In Embodiment 4, the control signal output from the timing controller is delayed by the delay circuit in the data driver to generate the timing with a plurality of cycles as the load timing of the control signal and to disperse frequency components of the driving signal generated in the driving circuit. However, as described in Embodiment 2, a method in which no delay is made in the data driver may also be used where a delay circuit is provided in a timing controller, and through delay processing of the control signal LOAD (IN), a signal whose pulse rise timing varies with respect to fixed timing determined by a constant cycle is generated as the control signal LOAD (OUT), and further the control signal which has been subject to such delay processing is output from the timing controller.

In Embodiment 4, the configuration has been described where the latch circuits 216-1 to **216-*n*, hold circuits 217-1 to 217-*n*, D/A converters 218-1 to 218-*n*, and output buffers 219-1 to 219-*n* in the data driver are all divided into groups; however, the data driver may have a structure in which only the hold circuits 217-1 to 217-*n*** are divided into groups.

(Embodiment 5)

Figure 13:
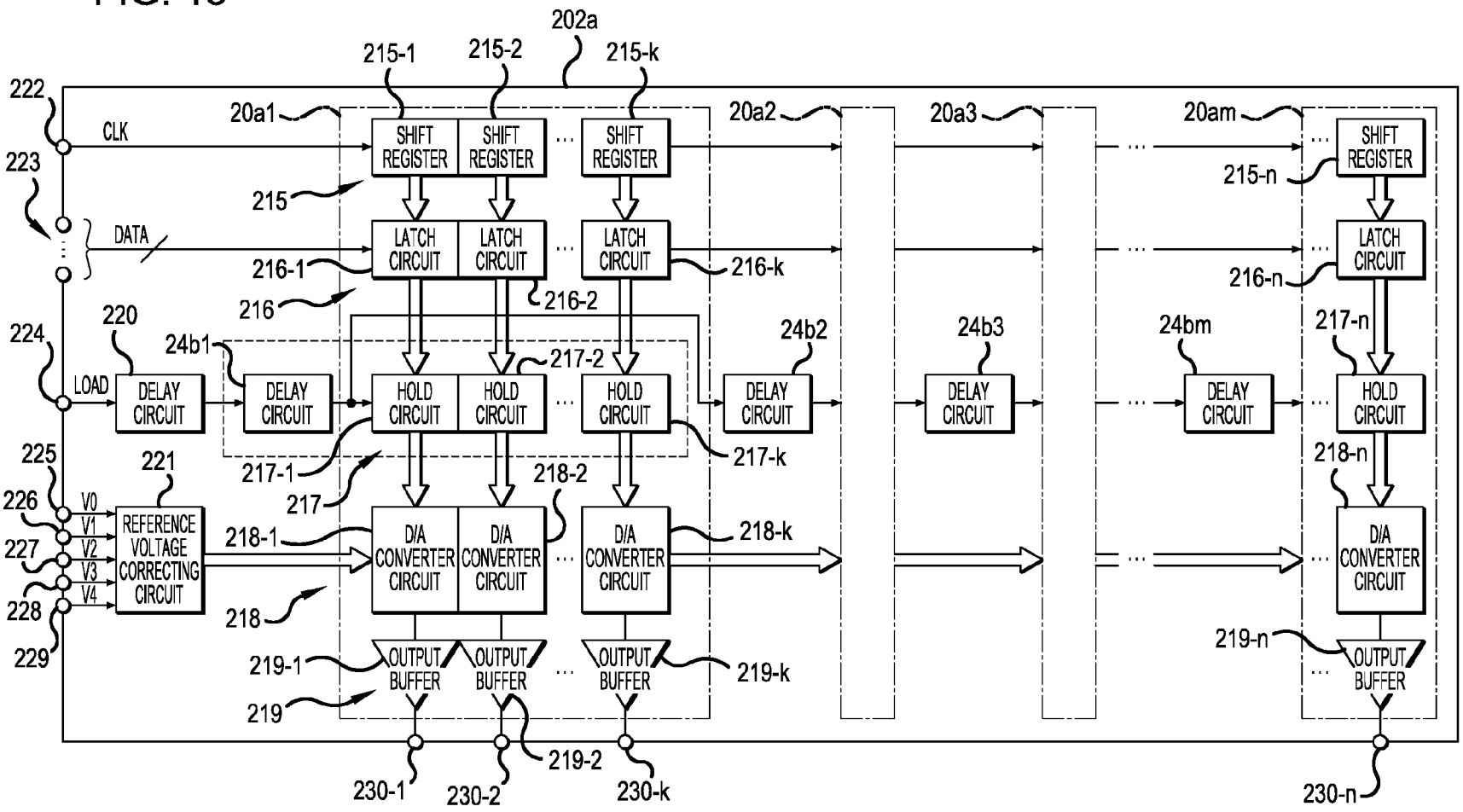
FIG. 13 is a block diagram showing a driving circuit (data driver) according to Embodiment 5 of the present invention.
Figure 14:
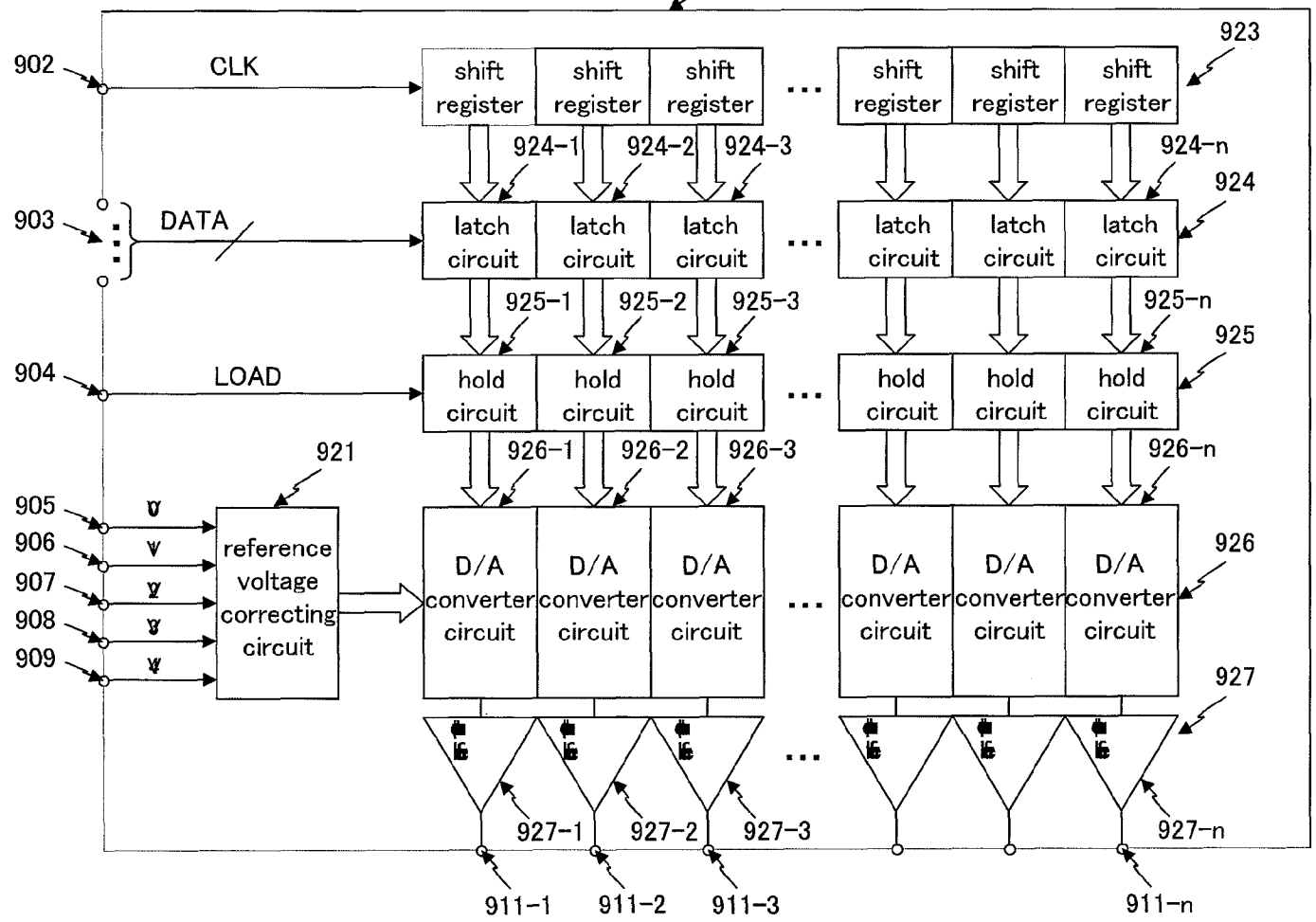
FIG. 14 Prior Art
FIG. 14 is a block diagram describing an example of a configuration of a conventional data driver.
Figure 15:
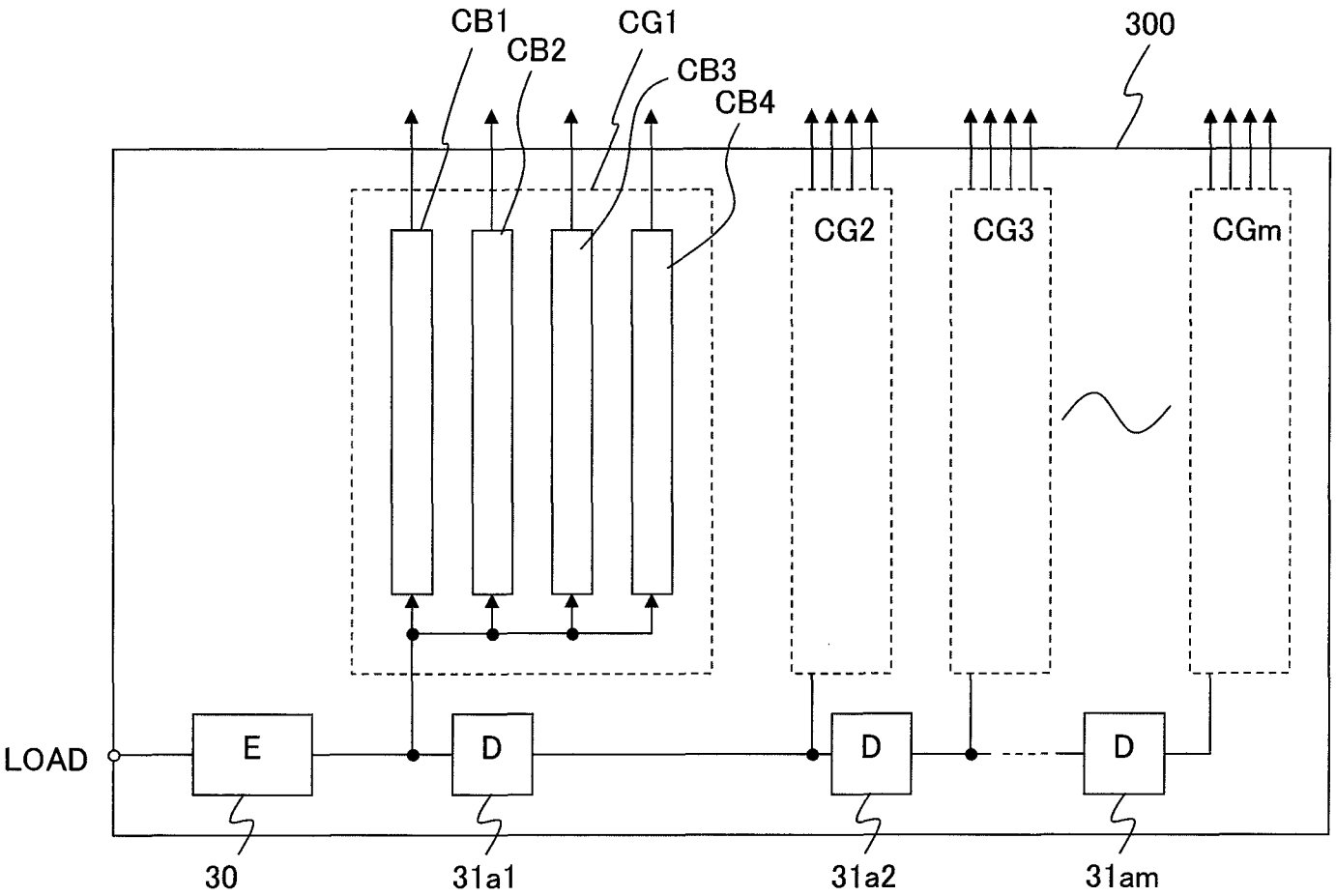
FIG. 15 Prior Art
FIG. 15 is a block diagram describing a configuration disclosed in Reference 1 as an example of a configuration of another conventional driving circuit.

FIG. 13 is a block diagram showing a driving circuit (data driver) according to Embodiment 5 of the present invention.

The driving circuit according to Embodiment 5 is obtained by replacing the delay circuit, having a fixed delay amount corresponding to each group in the data driver according to Embodiment 4, with the delay circuit shown in FIG. 12 which varies a delay amount based on the count number of the control signal. The rest of the configuration is identical to that of the data driver according to Embodiment 4.

The data driver according to Embodiment 5 with such a configuration can achieve an effect of varying a delay amount of a control signal more precisely for each group, in addition to the effect in Embodiment 4.

In Embodiments 4 and 5, the timing for loading display data to a liquid crystal display panel is different among a plurality of groups obtained by grouping circuits in one data driver. However, it is also possible to differently set the timing for loading display data to a liquid crystal display panel among a plurality of data drivers.

Thus, the load timing of display data is shifted among a plurality of driving circuits (data drivers) with reduced unnecessary radiation, so that unnecessary radiation in the entire display device can be further reduced.

In Embodiment 5, a driving circuit has been described which is obtained by replacing the delay circuit, having a fixed delay amount corresponding to each group in the data driver according to Embodiment 4, with the delay circuit with a variable delay amount shown in FIG. 12. However, the delay circuit with a fixed delay amount corresponding to each group in the data driver according to Embodiment 4 may be replaced by the delay circuit with a variable delay amount using a shift register as shown in FIG. 9.

In addition, the liquid crystal display apparatus including the driving circuit as described in Embodiments 1 to 5 can be utilized as a display apparatus of an electronic information device, such as a cell phone device, a personal computer, and a television set.

As described above, the present invention is exemplified by the use of its preferred embodiments. However, the present invention should not be interpreted solely based on the embodiments described above. It is understood that the scope of the present invention should be interpreted solely based on the claims. It is also understood that those skilled in the art can implement equivalent scope of technology, based on the description of the present invention and common knowledge from the description of the detailed preferred embodiments of the present invention. Furthermore, it is understood that any patent, any patent application and any references cited in the present specification should be incorporated by reference in the present specification in the same manner as the contents are specifically described therein.

INDUSTRIAL APPLICABILITY

The present invention can be applied in the field of a driving circuit, a liquid crystal display apparatus and an electronic information device. According to the present invention, it is possible to provide a driving circuit capable of reducing unnecessary radiation by changing output timing of the driving circuit for each horizontal synchronization period or for each plurality of horizontal synchronization periods to disperse frequencies; a liquid crystal display apparatus equipped with such a driving circuit; and an electronic information device including such a liquid crystal display apparatus.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for driving a liquid crystal display apparatus based on display data and a control signal, comprising:

a delay circuit for delaying the control signal to obtain a delayed control signal; and a data load section for loading the display data to the display apparatus at a load timing generated by the delayed control signal, wherein the delay circuit delays the control signal in such a manner that the load timing to the display apparatus varies with respect to a fixed timing of one horizontal synchronization period, and that the load timing forms cycles which vary with respect to the horizontal synchronization period, wherein the load timing is delayed from the fixed timing by a given delay period which varies in accordance with the number of elapsed horizontal synchronization periods, a plurality of delay elements connected in series; and a plurality of switches for switching signal paths of the control signal so that the control signal is delayed by a given number of the delay elements connected in series among the plurality of delay elements, based on an output of a decoder, wherein each length of the given delay period is shorter than one horizontal synchronization period.

2. A driving circuit according to claim 1, wherein the control signal is a signal for generating the fixed timing of the horizontal synchronization period and the delay circuit repeats delay processing for the control signal.

3. A driving circuit according to claim 2, wherein the display data and the control signal are included in a video signal supplied to the display apparatus, and the horizontal synchronization period is a horizontal synchronization period of the video signal.

4. A driving circuit according to claim 3, including:

a data driver for driving a plurality of data lines of a liquid crystal display panel as the display apparatus;

a scanning driver for driving a plurality of scanning lines of the liquid crystal display panel; and a timing controller for generating, based on an input video signal, the display data supplied to the data driver as well as generating, as the control signal, a data control signal supplied to the data driver and a scan control signal supplied to the scanning driver, wherein:

the delay circuit constitutes the data driver; and the delay circuit delays the control signal input to the data driver in such a manner that timing, at which the display data is output from the data driver to a data line of the liquid crystal display panel, varies for each horizontal scanning line according to fixed timing determined based on a horizontal synchronization signal.

5. A driving circuit according to claim 3, including:

a data driver for driving a plurality of data lines of a liquid crystal display panel as the display apparatus;

a scanning driver for driving a plurality of scanning lines of the liquid crystal display panel; and a timing controller for generating, based on an input video signal, the display data supplied to the data driver as well as generating, as the control signal, a data control signal supplied to the data driver and a scan control signal supplied to the scanning driver, wherein:

the delay circuit constitutes the timing controller; and the delay circuit delays the control signal generated by the timing controller based on the video signal in such a manner that timing, at which the display data is output from the data driver to a data line of the liquid crystal display panel, varies for each horizontal scanning line according to fixed timing determined based on a horizontal synchronization signal.

6. A liquid crystal display apparatus comprising a liquid crystal display panel, for displaying an image on the liquid crystal display panel based on a video signal, the liquid crystal display apparatus further comprising:

a driving apparatus for driving the liquid crystal display panel based on the video signal, wherein the driving apparatus includes the driving circuit according to claim 3.

7. A liquid crystal display apparatus comprising a liquid crystal display panel, for displaying an image on the liquid crystal display panel based on a video signal, the liquid crystal display apparatus further comprising:

a driving apparatus for driving the liquid crystal display panel based on the video signal, wherein the driving apparatus includes the driving circuit according to claim 2.

8. A driving circuit according to claim 1, wherein the delay circuit includes:

a count circuit for counting the fixed timing generated by the control signal; and the decoder for decoding a count output of the count circuit, wherein a delay amount of the control signal is determined based on an output of the decoder.

9. A liquid crystal display apparatus comprising a liquid crystal display panel, for displaying an image on the liquid crystal display panel based on a video signal, the liquid crystal display apparatus further comprising:

a driving apparatus for driving the liquid crystal display panel based on the video signal, wherein the driving apparatus includes the driving circuit according to claim 8.

10. A liquid crystal display apparatus comprising a liquid crystal display panel, for displaying an image on the liquid crystal display panel based on a video signal, the liquid crystal display apparatus further comprising:

a driving apparatus for driving the liquid crystal display panel based on the video signal, wherein the driving apparatus includes the driving circuit according to claim 8.

11. A driving circuit according to claim 1, wherein the delay circuit includes:

a shift register for performing a shift operation based on the fixed timing generated by the control signal;

a plurality of delay elements connected in series; and a plurality of switches for switching signal paths of the control signal so that the control signal is delayed by a given number of the delay elements connected in series among the plurality of delay elements, based on an output of the shift register.

12. A driving circuit according to claim 1, including a data driver for driving a plurality of data lines of a liquid crystal display panel as the display apparatus, wherein:

the delay circuit constitutes the data driver, for delaying the control signal input in the data driver; and the data driver includes:

a plurality of driver circuits in a plurality of groups, provided for each data line of the liquid crystal display panel, for driving the corresponding data line, the plurality of driver circuits being grouped into a plurality of groups; and a signal delay section for delaying the control signal supplied to the driver circuits in each group in such a manner that the driver circuits in the same group supply the display data to the data line at the same timing, and the driver circuits in a different group supply the display data to the data line at a different timing.

13. A driving circuit according to claim 12, wherein:

the signal delay section includes a plurality of delay sections connected in series over a plurality of stages;

the delay section in a first stage delays the control signal output from the delay circuit; and the delay sections in a second stage and later stages delay the control signal output from the delay section in the previous stage.

14. A driving circuit according to claim 13, wherein the delay sections constituting the signal delay section respectively delay the control signal by a predetermined amount.

15. A driving circuit according to claim 13, wherein the plurality of delay sections include:

a count circuit for counting timing of a fixed cycle generated by the control signal; and a decoder for decoding a count output of the count circuit, and a delay amount of the control signal is determined based on an output of the decoder.

16. A driving circuit according to claim 15, wherein the plurality of delay sections include:

a plurality of delay elements connected in series; and a plurality of switches for switching signal paths of the control signal so that the control signal is delayed by a given number of the delay elements connected in series among the plurality of delay elements, based on an output of the decoder.

17. A driving circuit according to claim 13, wherein the plurality of delay sections include:

a shift register for performing a shift operation based on fixed cycle timing generated by the control signal;

a plurality of delay elements connected in series; and a plurality of switches for switching signal paths of the control signal so that the control signal is delayed by a given number of the delay elements connected in series among the plurality of delay elements, based on an output of the shift register.

18. A liquid crystal display apparatus comprising a liquid crystal display panel, for displaying an image on the liquid crystal display panel based on a video signal, the liquid crystal display apparatus further comprising:

a driving apparatus for driving the liquid crystal display panel based on the video signal, wherein the driving apparatus includes the driving circuit according to claim 1.

19. An electronic information device comprising a liquid crystal display apparatus, wherein the liquid crystal display apparatus is the liquid crystal display apparatus according to claim 18.

* * * * *